US012422156B2

(12) United States Patent
Shin et al.

(10) Patent No.: US 12,422,156 B2
(45) Date of Patent: Sep. 23, 2025

(54) OUTDOOR UNIT OF AIR CONDITIONER

(71) Applicant: SAMSUNG ELECTRONICS CO., LTD., Suwon-si (KR)

(72) Inventors: Kwangnam Shin, Suwon-si (KR); Woong Sun, Suwon-si (KR); Jaechan Park, Suwon-si (KR); Jeonguk Koh, Suwon-si (KR); Seungjin Yun, Suwon-si (KR); Soonjae Pyo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 144 days.

(21) Appl. No.: 18/507,752

(22) Filed: Nov. 13, 2023

(65) Prior Publication Data

US 2024/0200814 A1 Jun. 20, 2024

Related U.S. Application Data

(63) Continuation of application No. PCT/KR2023/015978, filed on Oct. 17, 2023.

(30) Foreign Application Priority Data

Dec. 19, 2022 (KR) ..... 10-2022-0178740

(51) Int. Cl.
*F24F 11/36* (2018.01)
*F24F 1/16* (2011.01)
(Continued)

(52) U.S. Cl.
CPC ..... *F24F 11/36* (2018.01); *F24F 1/16* (2013.01); *F24F 1/22* (2013.01); *F24F 1/38* (2013.01); *F24F 1/56* (2013.01); *F24F 11/89* (2018.01)

(58) Field of Classification Search
CPC ..... F24F 1/20; F24F 1/22; F24F 1/24; F24F 11/36
See application file for complete search history.

(56) References Cited

U.S. PATENT DOCUMENTS 4,736,598 A * 4/1988 Sameshima ..... F24F 1/22 62/448
6,438,985 B1 * 8/2002 Hayashi ..... F24F 1/0003 62/298
(Continued)

FOREIGN PATENT DOCUMENTS

EP 3 263 997 A1 1/2018
JP 11-304310 A 11/1999
(Continued)

OTHER PUBLICATIONS

International Search Report dated Jan. 31, 2024 for International application No. PCT/KR2023/015978.
(Continued)

*Primary Examiner* — Christopher R Zerphey
(74) *Attorney, Agent, or Firm* — STAAS & HALSEY LLP

(57) ABSTRACT

An outdoor unit of an air conditioner, including a cabinet; a heat exchange room inside the cabinet; a component room case at one side of the heat exchange room, including an opening in a first side of the component room case; a component room inside the component room case; an electric component in the component room; a case cover to cover the opening of the component room case; a sealing member between the component room case and the case cover; a duct at a second side of the component room case, and connected to the heat exchange room; and a duct hole in the second side of the component room case connecting the component room case and the duct. The component room case and the
(Continued)

duct are configured so that a refrigerant in the component room flows through the duct hole, and then the duct, to outside of the cabinet.

14 Claims, 25 Drawing Sheets

(51) Int. Cl.

| | |
|---|---|
| ***F24F 1/22*** | (2011.01) |
| ***F24F 1/38*** | (2011.01) |
| ***F24F 1/56*** | (2011.01) |
| ***F24F 11/89*** | (2018.01) |

(56) References Cited

U.S. PATENT DOCUMENTS

| | | | | |
|---|---|---|---|---|
| 9,228,771 | B2 * | 1/2016 | Kamitani | F24F 1/22 |
| 9,863,650 | B2 * | 1/2018 | Yi | F04D 29/5806 |
| 10,429,089 | B2 * | 10/2019 | Jeon | F24F 1/24 |
| 10,569,617 | B2 * | 2/2020 | Lim | B60H 1/00528 |
| 10,928,080 | B2 * | 2/2021 | Shoemaker | F24F 1/50 |
| 11,339,977 | B2 * | 5/2022 | Devrath | F24F 1/48 |
| 12,048,114 | B2 * | 7/2024 | Koehler | H05K 7/20318 |
| 12,085,317 | B2 * | 9/2024 | Rokade | F24F 1/22 |
| 2009/0081940 | A1 * | 3/2009 | Jang | F24F 1/22 454/184 |

FOREIGN PATENT DOCUMENTS

| | | | |
|---|---|---|---|
| JP | 2000-105003 | A | 4/2000 |
| JP | 2005-308328 | A | 11/2005 |
| JP | 2016-156563 | | 9/2016 |
| JP | 6882716 | | 6/2021 |
| KR | 1999-0043518 | A | 6/1999 |
| KR | 2002-0048701 | | 6/2002 |
| KR | 10-2004-0080811 | | 9/2004 |
| KR | 10-0495555 | B1 | 6/2005 |
| KR | 10-2009-0002735 | | 1/2009 |
| KR | 10-1389447 | | 5/2014 |
| KR | 10-1389447 | B1 | 5/2014 |
| KR | 10-2015-0084371 | | 7/2015 |
| KR | 10-2018-0018093 | | 2/2018 |
| KR | 10-2022-0150617 | | 11/2022 |

OTHER PUBLICATIONS

Written Opinion of International Searching Authority dated Jan. 31, 2024 for International application No. PCT/KR2023/015978.

* cited by examiner

OUTDOOR UNIT OF AIR CONDITIONER

CROSS-REFERENCE TO RELATED APPLICATIONS

This application is a continuation application, under 35 U.S.C. § 111(a), of International Application No. PCT/KR2023/015978 filed on Oct. 17, 2023, which claims priority under 35 U.S.C. § 119 to Korean Patent Application No. 10-2022-0178740, filed on Dec. 19, 2022, in the Korean Intellectual Property Office, the disclosures of which are incorporated by reference herein in their entireties.

BACKGROUND

1. Field

The disclosure relates to an outdoor unit of an air conditioner, and more particularly, to an outdoor unit of an air conditioner capable of preventing explosion caused by refrigerant leakage.

2. Description of the Related Art

An air conditioner is an apparatus for adjusting temperature, humidity, air current, distribution, etc., to conditions suitable for human activities by using a cooling cycle. Main components constituting the cooling cycle include a compressor, a condenser, an evaporator, a blow fan, etc.

Air conditioners are classified into a split type air conditioner in which an indoor unit is separated from an outdoor unit, and a window type air conditioner in which an indoor unit and an outdoor unit are installed together in a single cabinet.

The outdoor unit of the split type air conditioner includes an outdoor heat exchanger for performing heat exchange with outside air, a compressor for compressing a refrigerant, an expander for decompressing the refrigerant, a blow fan for forming a flow of air, and a cabinet for accommodating the outdoor heat exchanger, the expander, the compressor, and the blow fan.

Also, the outdoor unit includes a refrigerant pipe positioned inside the cabinet and connecting the heat exchanger, the compressor, and the expander to each other, wherein the refrigerant flows inside the refrigerant pipe, and a controller for controlling the heat exchanger, the compressor, etc. The controller is provided as an electric component and positioned inside the cabinet.

Meanwhile, lately, there is a demand to replace refrigerants used in air conditioners with eco-friendly refrigerants. R290 is one of such eco-friendly refrigerants. However, the eco-friendly refrigerants may be combustible and/or explosive. Furthermore, R290 as an eco-friendly refrigerant is heavier than air.

At a refrigerant pipe, or at some parts of the refrigerant pipe, connected to the heat exchanger, the compressor, and the expander, refrigerant leakage may occur. In the case in which an eco-friendly refrigerant is used in the air conditioner, a leaking refrigerant may be collected in the cabinet because the refrigerant is heavier than air. The refrigerant collected inside the cabinet without being discharged to the outside of the cabinet may flow to the machine room where electric components are installed, and may cause a fire or explosion by reacting with sparks generated in the electric components.

SUMMARY

Aspects of embodiments of the disclosure will be set forth in part in the description which follows and, in part, will be apparent from the description, or may be learned by practice of the presented embodiments.

According to an embodiment of the disclosure, an outdoor unit of an air conditioner includes a cabinet; a heat exchange room inside the cabinet and accommodating a heat exchanger; a first component room case at one side of the heat exchange room, and including an opening in a first side of the first component room case; a first component room inside the first component room case; a first electric component in the first component room; a first case cover configured to cover the opening of the first component room case; a sealing member between the first component room case and the first case cover; a duct at a second side of the first component room case, and connected to the heat exchange room; and a first duct hole in the second side of the first component room case and connecting the first component room case and the duct. The first component room case and the duct are configured so that a refrigerant in the first component room flows through the first duct hole, and then through the duct, to outside of the cabinet.

According to an embodiment of the disclosure, the outdoor unit of the air conditioner may further include a discharge hose connecting the first component room case and the cabinet so that the refrigerant in the first component room flows from the first component room through the discharge hose to outside of the cabinet.

According to an embodiment of the disclosure, the outdoor unit of the air conditioner may further include a blow fan inside the heat exchange room and configured to move air. The refrigerant in the first component room may flow through the discharge hose to outside of the cabinet in response to a rotation of the blow fan in a first rotation direction.

According to an embodiment of the disclosure, the refrigerant in the first component room may flow from the first component room through the first duct hole, then through the duct to the heat exchange room in response to a rotation of the blow fan in a second rotation direction.

According to an embodiment of the disclosure, the outdoor unit of the air conditioner may further include a second component room beside the first component room. The second component room may be in a front area of the cabinet. The duct may communicate with the heat exchange room, the first component room, and the second component room.

According to an embodiment of the disclosure, the outdoor unit of the air conditioner may further include a second component room case beside the first component room case, and including an opening in a first side of the second component room case, the second component room inside the second component room case; a second duct hole formed in a second side of the second component room case and connecting the second component room case and the duct. The first component room case may include a hose hole in a bottom of the first component room case connecting the discharge hose to the first component room case.

According to an embodiment of the disclosure, the first duct hole may include a plurality of first duct holes. The second duct hole may include a plurality of second duct holes. The plurality of first duct holes may be formed at upper and lower portions of the second side of the first component room case. The plurality of second duct holes may be formed at upper and lower portions of the second side of the second component room case. Refrigerant in the second component room may flow through second duct holes of the plurality of second duct holes formed at the lower portion of the second side of the second component room case, then through the duct, then through first duct holes of the plurality of first duct holes formed at the lower portion of the second side of the first component room case, and then through the hose hole to the discharge hose while the blow fan does not rotate.

According to an embodiment of the disclosure, the sealing member may include a first sealing portion extending from between the first component room case and the first case cover to between the first case cover and the opening of the first component room case, a second sealing portion extending from the first sealing portion toward inside of the first component room case, a third sealing portion extending from the second sealing portion toward a center of the opening of the first component room case, and a fourth sealing portion extending from the second sealing portion to contact an inner portion of the first component room case.

According to an embodiment of the disclosure, the first case cover may include a cover portion configured to cover the first side of the first component room case, a first protrusion protruding from the cover portion toward the inside of the first component room and configured to guide the sealing member between the first component room case and the first case cover, and a second protrusion protruding from the first protrusion toward the inner portion of the first component room case and inserted between the first sealing portion and the third sealing portion.

According to an embodiment of the disclosure, the outdoor unit of the air conditioner may further include a second component room case beside the first component room case in a front area of the cabinet, and including an opening in a first side of the second component room case; a second component room inside the second component room case; a second electric component in the second component room; and a second case cover configured to cover the opening of the second component room case. The sealing member may include a first sealing member between the first component room case and the first case cover, and a second sealing member between the second component room case and the second case cover.

According to an embodiment of the disclosure, the outdoor unit of the air conditioner may further include an electric component box positioned inside the second component room case and accommodating the second electric component; a heat transfer member positioned behind the electric component box and configured to receive heat generated in the second electric component; a heat exchange fin positioned inside the duct and coupled to the heat transfer member to cool the second electric component; and a third sealing member at a circumference of the heat transfer member.

According to an embodiment of the disclosure, the cabinet may include a front panel. The outdoor unit of the air conditioner may further include a discharge hole in the front panel below the first component room, and configured to communicate inside of the cabinet with outside of the cabinet to prevent refrigerant inside the cabinet from flowing into the first component room, and a guide inside the cabinet and adjacent to the front panel below the first component room, and configured to guide the refrigerant inside the cabinet to the discharge hole.

According to an embodiment of the disclosure, the guide may include a base extending in an up-down direction, a pair of panel portions at both respective sides of the base to accommodate a wire connected to the first electric component, and a protrusion portion protruding in a front direction from the base and configured to guide the refrigerant to the discharge hole.

According to an embodiment of the disclosure, the outdoor unit of the air conditioner may further include a blocking member between the front panel and the protrusion portion, and configured to block the refrigerant inside the cabinet from flowing from a lower portion of the cabinet to the first component room.

According to an embodiment of the disclosure, a portion of the front panel corresponding to the protrusion portion may protrude in the front direction. The discharge hole may extend from a same position as the guide to a base of the cabinet.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
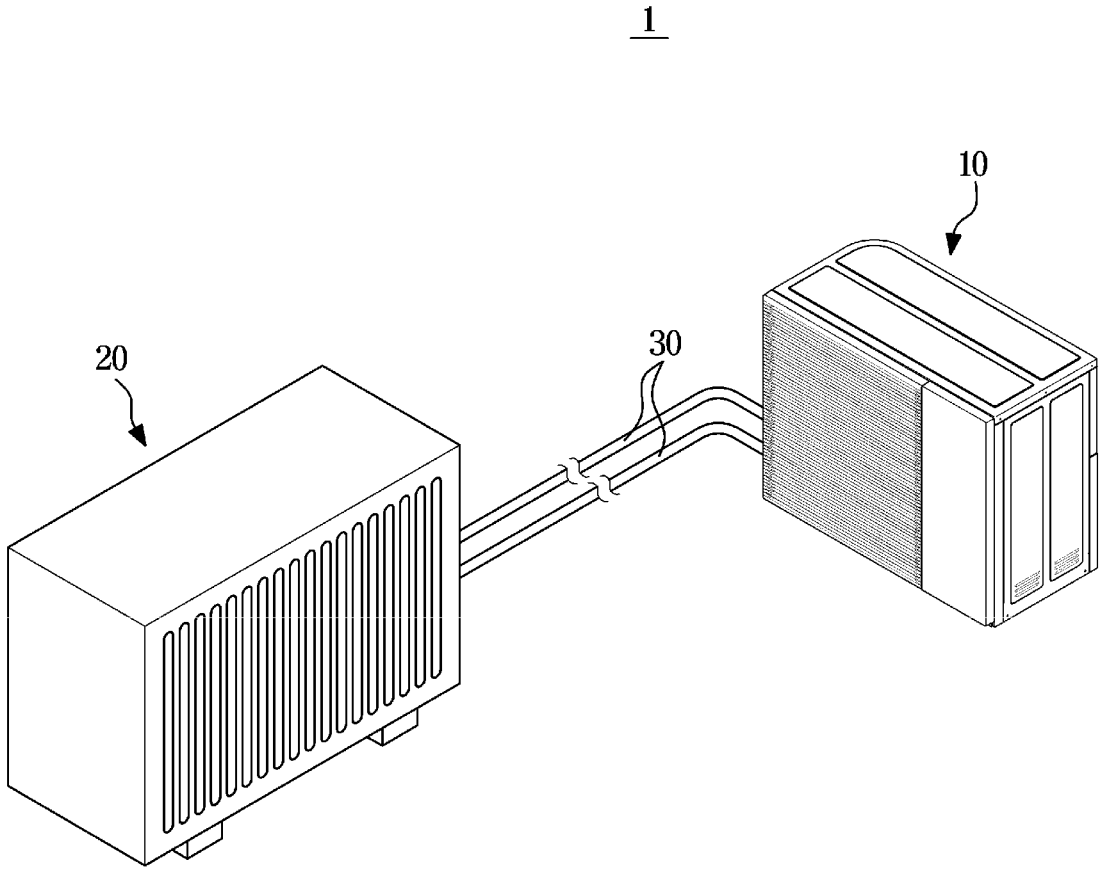
FIG. 1 is a perspective view of an air conditioner according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

For example, the first component room case may be the second component room case, the first component room may be the second component room, the first cover may be the second cover, and the first component may be the second component. Further, for example, the second component room case may be the first component room case, the second component room may be the first component room, the second cover may be the first cover, and the second component room may be the first component room.

Also, in this specification, the meaning of 'identical' may include similar in attribute or similar within a certain range. Also, the term 'identical' means 'substantially identical'. The meaning of 'substantially identical' should be understood that a value falling within the margin of error in manufacturing or a value corresponding to a difference within a meaningless range with respect to a reference value is included in the range of 'identical'.

In addition, the terms "portion", "device", "block", "member", and "module" used herein refer to a unit for processing at least one function or operation. For example, the terms may mean at least one process that may be processed by at least one hardware such as field-programmable gate array (FPGA) or application specific integrated circuit (ASIC), or at least one software or processor stored in a memory.

Meanwhile, in the following description, the terms "front", "rear", "left", and "right" are defined based on the drawings, and the shapes and positions of the components are not limited by the terms.

Figure 2:
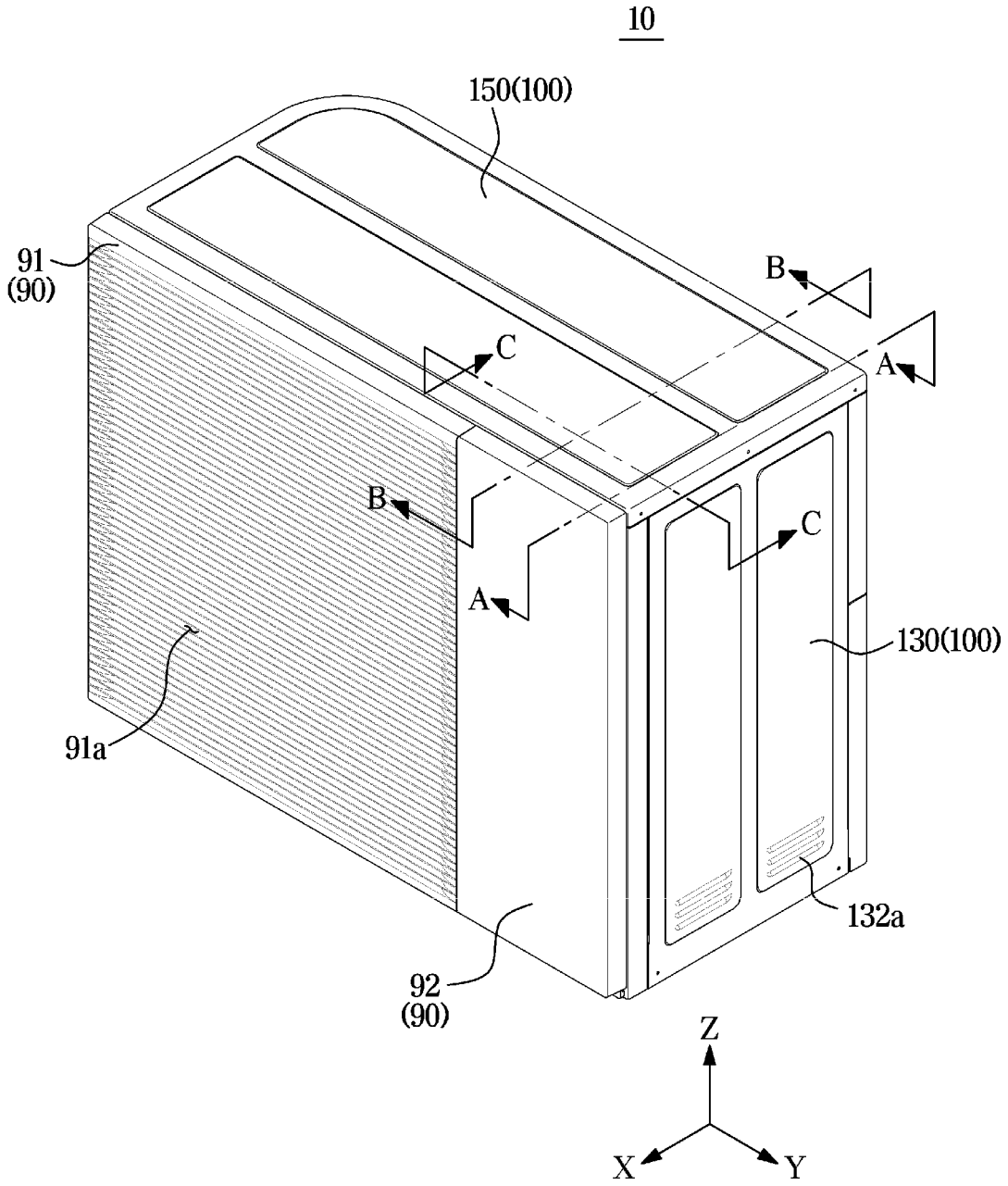
FIG. 2 is a perspective view of an outdoor unit of an air conditioner according to an embodiment of the disclosure.

For example, the terms "upper direction" and "lower direction" may respectively represent an upper direction in a Z direction and a lower direction in an opposite direction of the Z direction in FIG. 2. The terms "front direction" and "rear direction" may respectively represent a front direction in an X direction and a rear direction in an opposite direction of the X direction in FIGS. 2 and 3. The terms "left direction" and "right direction" may respectively represent a Y direction and an opposite direction of the Y direction in FIGS. 2 and 3.

The opposite direction of the X direction, the opposite direction of the Y direction, and the opposite direction of the Z direction may be referred to as a −X direction, a −Y direction, and a −Z direction, respectively. Also, the X direction may be referred to as a first direction, the Y direction may be referred to a second direction, and the Z direction may be referred to as a third direction.

Embodiments of the disclosure may provide an outdoor unit of an air conditioner capable of preventing explosion.

Embodiments of the disclosure may provide an outdoor unit of an air conditioner capable of smoothly discharging a refrigerant without collecting the refrigerant inside a cabinet.

Embodiments of the disclosure are not limited to the various aspects mentioned above, and other aspects may become apparent to one of ordinary skill in the technical art to which the disclosure belongs from the following description.

Hereinafter, embodiments of the disclosure will be described in detail with reference to the accompanying drawings.

FIG. 1 is a perspective view of an air conditioner according to an embodiment of the disclosure.

Referring to FIG. 1, an air conditioner 1 according to an embodiment of the disclosure may include an indoor unit 20 positioned in an indoor space and an outdoor unit 10 positioned in an outdoor space.

To cool an air-conditioned space to be air-conditioned, the air conditioner 1 may absorb heat inside the air-conditioned space and emit heat outside the air-conditioned space. Also, to heat the air-conditioned space, the air conditioner 1 may absorb heat outside the air-conditioned space and emit heat inside the air-conditioned space.

The outdoor unit 10 may exchange heat with outside air outside the air-conditioned space. The outdoor unit 10 may perform heat exchange between a refrigerant and outside air by using a phase change (for example, evaporation or condensation) of the refrigerant. For example, the outdoor unit 10 may discharge heat of a refrigerant to outside air by using condensation of the refrigerant. Also, the outdoor unit 10 may absorb heat of outside air into a refrigerant by using evaporation of the refrigerant.

In FIG. 1, a single outdoor unit 10 is shown, however, a number of the outdoor unit 10 is not limited to that shown in FIG. 1. For example, the air conditioner 1 may include a plurality of outdoor units.

The outdoor unit 10 may include an outdoor heat exchanger 11 (see FIG. 4) that performs heat exchange with outside air, and a compressor 12 (see FIG. 4) that compresses a refrigerant gas.

The indoor unit 20 may exchange heat with indoor air inside the air-conditioned space. The indoor unit 20 may perform heat exchange between a refrigerant and indoor air by using a phase change (for example, evaporation or condensation) of the refrigerant. For example, the indoor unit 20 may absorb heat of indoor air into a refrigerant by using evaporation of the refrigerant to cool the air-conditioned space. Also, the indoor unit 20 may discharge heat of a refrigerant to indoor air by using condensation of the refrigerant to heat the air-conditioned space. For example, the indoor unit 20 may be a radiator. However, a kind of the indoor unit 20 is not limited to this example.

The indoor unit 20 may include an indoor heat exchanger that performs heat exchange with indoor air, an indoor blow fan that sucks and blows indoor air to cause the indoor air to pass through the indoor heat exchanger, and an expander that decompresses a refrigerant and expands the refrigerant.

In FIG. 1, a single indoor unit 20 is shown, however, a number of the indoor unit 20 is not limited to that shown in FIG. 1. For example, the air conditioner 1 may include a plurality of indoor units. A plurality of different indoor units may be installed in a plurality of different air-conditioned spaces 20, respectively.

As such, the air conditioner 1 may perform heat exchange between a refrigerant and outside air outside the air-conditioned space, and perform heat exchange between the refrigerant and indoor air inside the air-conditioned space.

In this case, to move heat between the inside and outside of the air-conditioned space, the air conditioner 1 may include a connecting pipe 30 that transfers the refrigerant between the indoor unit 20 and the outdoor unit 10. The connecting pipe 30 may move the refrigerant between the outside and inside of the air-conditioned space.

The indoor unit 20 may be connected to the outdoor unit 10 through the connecting pipe 30 that transfers the refrigerant. Also, although not shown in the drawings, the indoor unit 20 may be connected to the outdoor unit 10 through a wire for transferring power and electrical signals.

The above-described air conditioner 1 may be an example of an air conditioner to which an outdoor unit of an air conditioner according to a concept of the disclosure is applicable, and a concept of the disclosure is not limited to the air conditioner 1. The air conditioner to which the outdoor unit of the air conditioner according to a concept of the disclosure is applicable, and components, such as an indoor unit, a connecting pipe, etc., included in the air conditioner, may be various.

Hereinafter, the outdoor unit 10 of the air conditioner 1 according to an embodiment of the disclosure will be described in detail. Also, for convenience of description, the outdoor heat exchanger 11 included in the outdoor unit 10 will be referred to as a heat exchanger 11, below.

Figure 3:
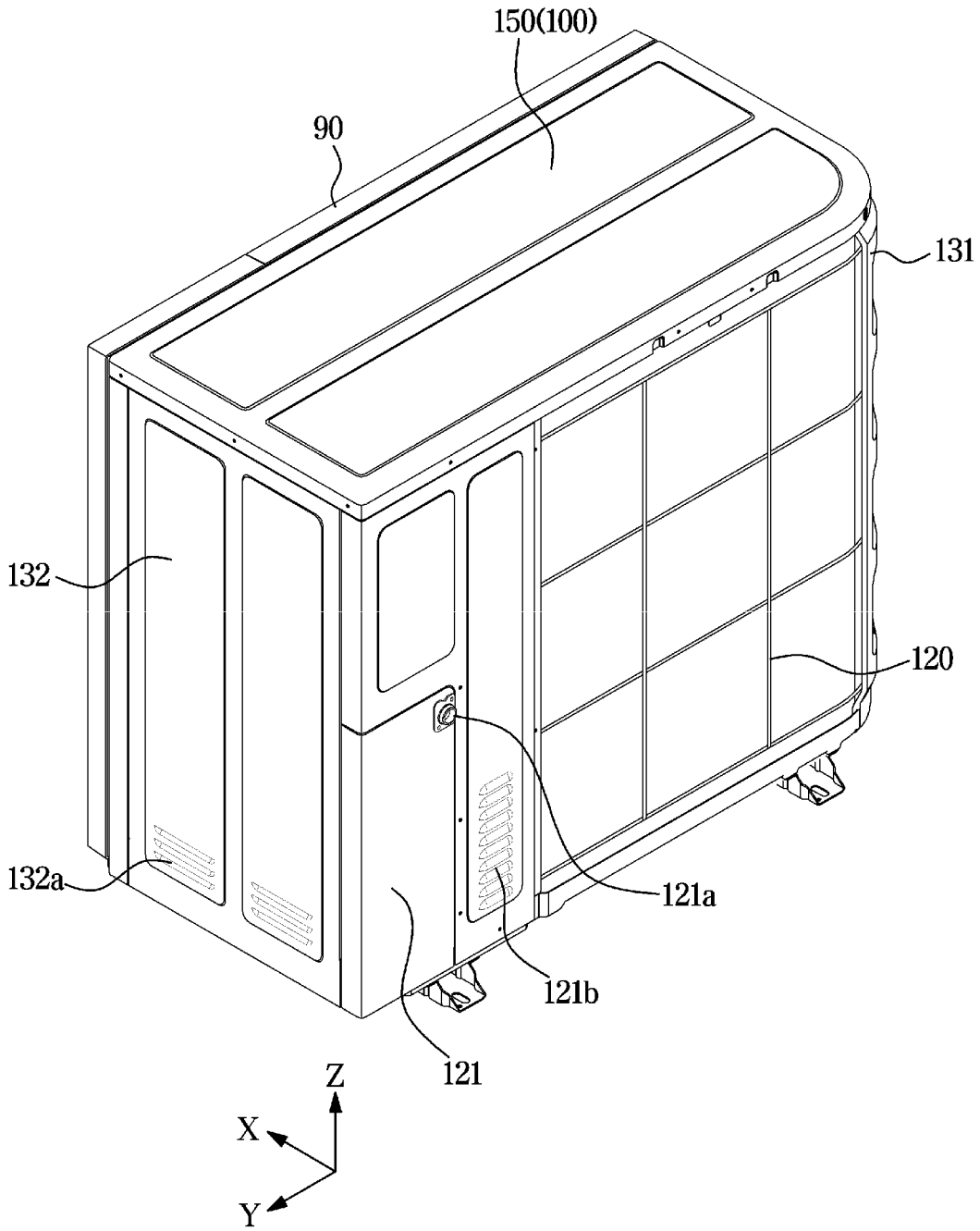
FIG. 3 is a rear perspective view of an outdoor unit of an air conditioner according to an embodiment of the disclosure.
Figure 4:
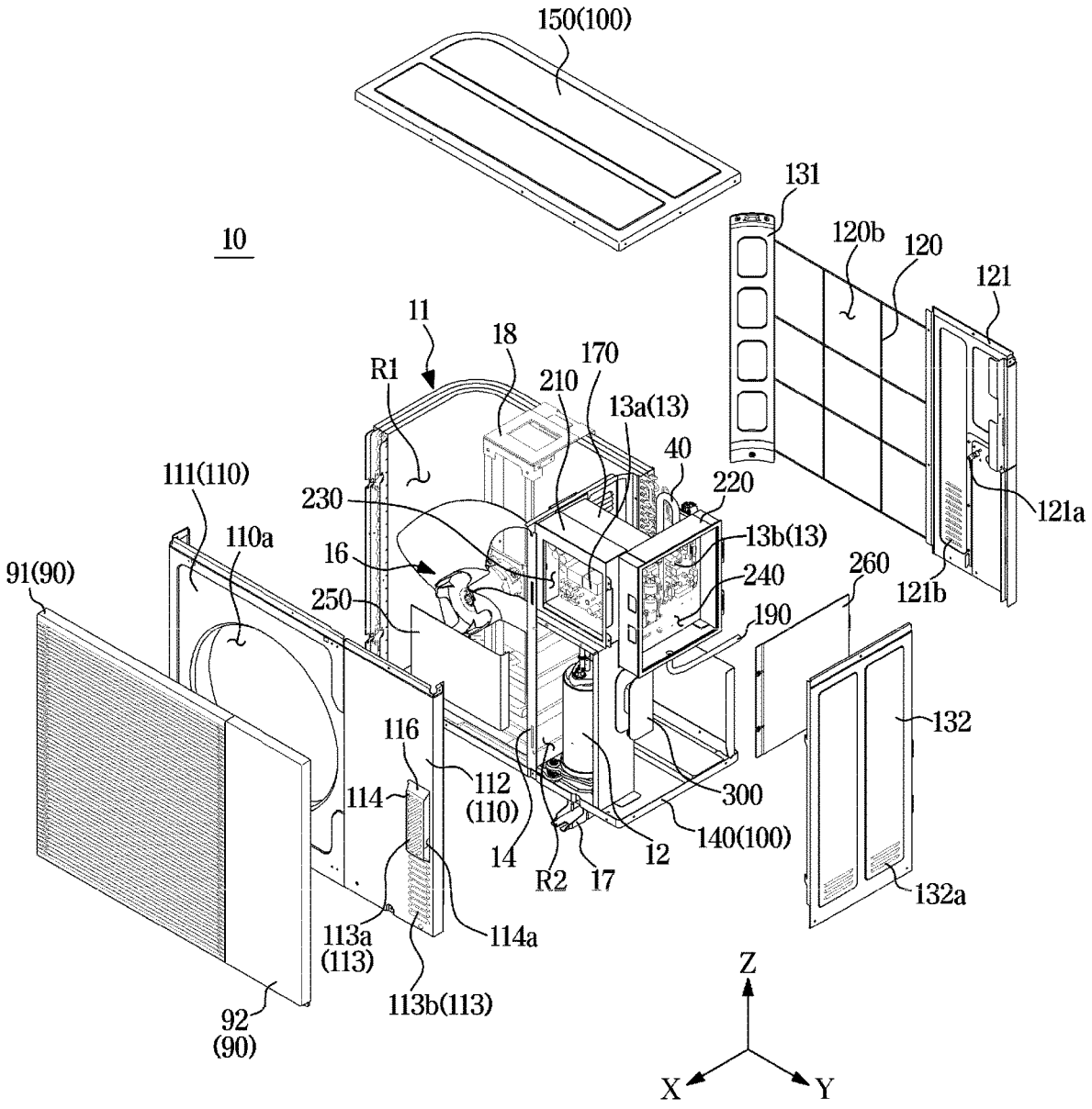
FIG. 4 is an exploded perspective view of an outdoor unit of an air conditioner according to an embodiment of the disclosure.

FIG. 2 is a perspective view of an outdoor unit of an air conditioner according to an embodiment of the disclosure. FIG. 3 is a rear perspective view of an outdoor unit of an air conditioner according to an embodiment of the disclosure. FIG. 4 is an exploded perspective view of an outdoor unit of an air conditioner according to an embodiment of the disclosure.

Referring to FIGS. 2 to 4, the outdoor unit 10 of the air conditioner 1 may include the heat exchanger 11 that performs heat exchange with outside air, the compressor 12 that compresses a refrigerant, a blow fan 16 that sucks outside air and blows the outside air to cause the outside air to pass through the heat exchanger 11, and a cabinet 100 forming an appearance of the outdoor unit 10.

The cabinet 100 may form the appearance of the outdoor unit 10. Various components, such as the heat exchanger 11, the compressor 12, the blow fan 16, etc., may be accommodated inside the cabinet 100.

The outdoor unit 10 may include a heat exchange room R1 formed inside the cabinet 100.

Outside air may enter the heat exchange room R1, and the air may be again discharged to outside. In the heat exchange room R1, heat exchange between the heat exchanger 11 and air entered into the heat exchanger 11 from the outside may occur. Components, such as the heat exchanger 11, the blow fan 16, etc., may be positioned in the heat exchange room R1.

The outdoor unit 10 may include a machine room R2 formed inside the cabinet 100.

In the machine room R2, components, such as the compressor 12, a refrigerant pipe 40, etc., may be positioned.

Inside the cabinet 100, the heat exchange room R1 may be partitioned from the machine room R2. The outdoor unit 10 may include a partition 14 that partitions the heat exchange room R1 from the machine room R2. The partition 14 may be positioned between the heat exchange room R1 and the machine room R2. For example, the heat exchange room R1 and the machine room R2 may be arranged along the Y direction, and the partition 14 may extend along the Z direction to partition the heat exchange room R1 from the machine room R2.

The cabinet 100 may include a front panel 110 forming a front appearance of the outdoor unit 10. The front panel 110 may be positioned toward a front direction of the outdoor unit 10. The front panel 110 may form a front portion of the outdoor unit 10. The "front portion" of the outdoor unit 10 means a front portion in the X direction in the drawings.

For example, the front panel 110 may cover front areas of the heat exchange room R1 and the machine room R2.

The front panel 110 may be formed in a shape of a substantially flat plate, although not limited thereto. However, the front panel 110 may have various shapes.

The front panel 110 may include a metal material, although not limited thereto. However, the front panel 110 may include various materials.

The front panel 110 may include a first panel portion 111 and a second panel portion 112. The first panel portion 111 and the second panel portion 112 may be arranged along the Y direction. The first panel portion 111 may be coupled to the second panel portion 112.

In the first panel portion 111, an inlet 110*a* through which air enters inside of the cabinet 100 may be formed. The first panel portion 111 may have a substantially quadrangular shape.

The second panel portion 112 may extend in an up-down direction. A discharge hole 113 may be formed in the second panel portion 112. The discharge hole 113 may be formed adjacent to one end of the second panel portion 112 in the Y direction. The discharge hole 113 formed in the front panel 110 may be referred to as a first discharge hole 113. The first discharge hole 113 may extend from a substantially middle part of the second panel portion 112 up to a lower part of the second panel portion 112. However, a position of the first discharge hole 113 is not limited to the above example, and the first discharge hole 113 may be formed in a side panel 130 or a rear panel 121.

The front panel 110 may include an inclined portion 116 and a protrusion portion 114.

The inclined portion 116 may protrude from the second panel portion 112 toward the protrusion portion 114.

The protrusion portion 114 may have a step with respect to the second panel portion 112. In the protrusion portion 114, a first part 113*a* of the first discharge hole 113 may be formed. Also, a protrusion portion hole 114*a* may be formed to sides of the protrusion portion 114 and the inclined portion 116.

The first discharge hole 113 may include the first part 113*a* and a second part 113*b*. The first part 113*a* may be formed in the substantially middle part of the second panel portion 112, and the second part 113*b* may be formed in the lower part of the second panel portion 112.

The discharge hole 113 may communicate the inside of the cabinet 100 with the outside of the cabinet 100 such that inside air of the cabinet 100 is exchanged with outside air of the cabinet 100 or moves toward the outside air.

The cabinet 100 may include a rear frame 120 and a rear panel 121 forming a portion of a rear appearance of the outdoor unit 10. The rear frame 120 and the rear panel 121 may be positioned in a rear portion of the cabinet 100. A "rear portion" of the outdoor unit 10 means a rear portion in the X direction in the drawings.

For example, the rear frame 120 may be positioned in a rear area of the heat exchange room R1.

The rear frame 120 may be configured with a plurality of bars that are coupled to each other by intersecting with each other. In other words, the rear frame 120 may have a shape in which a plurality of bars are arranged substantially in a lattice form.

Each of the plurality of bars of the rear frame 120 may include a metal material. The plurality of bars of the rear frame 120 may be coupled to each other by welding, etc., although not limited thereto. However, the rear frame 120 may have various shapes, and include various materials.

Generally, in the outdoor unit 10 installed in an outdoor space, the rear frame 120 may be positioned toward an outer wall, etc., of a building.

For example, the rear panel 121 may be positioned behind the machine room R2. The rear panel 121 may cover a rear area of the machine room R2. The rear panel 121 may extend along the up-down direction.

The outdoor unit 10 according to an embodiment of the disclosure may include discharge holes 121*a* and 121*b* formed in the rear panel 121. The discharge holes 121*a* and 121*b* formed in the rear panel 121 may include a second discharge hole 121*a* and a third discharge hole 121*b*.

The second discharge hole 121*a* may be formed at a substantially middle portion of the rear panel 121. The second discharge hole 121*a* may be connected to a discharge hose 190 which will be described below. The third discharge hole 121*b* may be formed in a lower portion of the rear panel 121.

The second discharge hole 121*a* and the third discharge hole 121*b* may communicate the inside of the cabinet 100 with the outside of the cabinet 100 such that inside air of the cabinet 100 is exchanged with outside air of the cabinet 100 or moves toward the outside air.

The cabinet 100 may include a side frame 130 forming an appearance in left-right direction of the outdoor unit 10. The side frame 130 may be positioned toward left and right directions of the outdoor unit 10. The side frame 130 may form a side surface in left-right direction of the outdoor unit 10. The side frame 130 may be referred to as a side panel 130.

The side frame 130 may include a first side frame 131 and a second side frame 132. The first side frame 131 may form one of both side surfaces in left-right direction of the cabinet 100, and the second side frame 132 may form another one of the both side surfaces in left-right direction of the cabinet 100.

For example, the first side frame 131 may cover the heat exchange room R1 The first side frame 131 may cover rear and side areas of the heat exchange room R1.

The first side frame 131 may have various shapes.

For example, the second side frame 132 may cover the machine room R2. At least one portion of the second side frame 132 may cover an area in the left-right direction of the machine room R2, and at least another portion of the second side frame 132 may cover the rear area of the machine room R3. That is, the second side frame 132 may form one of the side surfaces in left-right direction of the cabinet 100, and a portion of the rear surface of the cabinet 100. The second side frame 132 may block the machine room R2 from the outside of the cabinet 100.

At least one portion of the second side frame 132 may cover the machine room R2 in the left direction and extend in a front-rear direction. The second side frame 132 may have various shapes.

The second side frame 132 may connect the front panel 110 to the rear panel 121. In other words, the second side frame 132 may be connected to the front panel 110 and the rear panel 121.

The outdoor unit 10 may further include a front cover 90 covering a front portion of the front panel 110. The front cover 90 may be positioned in front of the front panel 110. The front cover 90 may include a first cover portion 91 and a second cover portion 92.

The cabinet 100 may include an inlet grille 160 covering the inlet 110*a*. The inlet grille 160 may be formed in the first cover portion 91. The inlet grille 160 may be substantially in a shape of a grille to pass air therethrough. The inlet grille 160 may have a shape corresponding to a shape of the inlet 110*a*.

The inlet grille 160 may form a portion of the front appearance of the outdoor unit 10. The inlet grille 160 may be positioned toward the front direction. The inlet grille 160 may cover a front side of the inlet 110*a*. The inlet grille 160 may cover the front area of the heat exchange room R1.

The second cover portion 92 may cover the second panel portion 112 to prevent the first discharge hole 113 from being exposed to the outside. Thereby, beauty of an overall appearance of the outdoor unit 10 may increase.

The front cover 90 may be a component included in the cabinet 100.

The cabinet 100 may include a base 140 forming a bottom of the outdoor unit 10. The base 140 may form a lower appearance of the outdoor unit 10. The base 140 may be positioned toward a down direction of the outdoor unit 10.

For example, the base 140 may cover lower areas of the heat exchange room R1 and the machine room R2. The base 140 may support various components of the outdoor unit 10, accommodated inside the cabinet 100.

The base 140 may be connected to lower portions of the front panel 110, the rear frame 120, and the side frame 130.

The base 140 may be formed in a shape of a substantially flat plate, although not limited thereto. However, the base 140 may have various shapes.

The base 140 may include a metal material, although not limited thereto. However, the base 140 may include various materials.

The outdoor unit 10 may include a leg 17 supporting the base 140. The leg 17 may be positioned below the base 140 to support overall components of the outdoor unit 10. A plurality of legs 17 may be provided.

The cabinet 100 may include a top cover 150 forming a top of the outdoor unit 10. The top cover 150 may form an upper appearance of the outdoor unit 10. The top cover 150 may be positioned toward an upper direction of the outdoor unit 10.

For example, the top cover 150 may cover upper areas of the heat exchange room R1 and the machine room R2. The top cover 150 may cover various components of the outdoor unit 10, accommodated inside the cabinet 100, from above.

The top cover 150 may be connected to upper portions of the front panel 110, the rear frame 120, and the side frame 130.

The top cover 150 may be formed in a shape of a substantially flat plate, although not limited thereto. However, the top cover 150 may have various shapes.

The top cover 150 may include a metal material, although not limited thereto. However, the top cover 150 may include various materials.

The front panel 110, the rear frame 120, the rear panel 121, the side frame 130, the base 140, the leg 17, the top cover 150, etc., which are components included in the cabinet 100, may be formed as separate components. However, at least some of the front panel 110, the rear frame 120, the rear panel 121, the side frame 130, the base 140, the leg 17, the top cover 150, etc., which are components included in the cabinet 100, may be integrated into one body.

For example, the cabinet 100 may be formed substantially in a shape of a box. That is, the outdoor unit 10 may be formed substantially in a shape of a box, although not limited thereto. However, the cabinet 100 may have various shapes.

The cabinet 100 may pass air therethrough. The cabinet 100 may include the inlet 110*a* through which outside air of the cabinet 100 enters the inside of the cabinet 100, and an outlet 120*b* through which inside air of the cabinet 100 is discharged to the outside of the cabinet 100.

The inlet 110*a* may communicate the inside of the cabinet 100 with the outside. Upon driving of the blow fan 16, outside air of the outdoor unit 10 may enter the inside of the cabinet 100 through the inlet 110*a*. For example, the inlet 110*a* may communicate the heat exchange room R1 with the outside of the cabinet 100, and upon driving of the blow fan 16, outside air of the outdoor unit 10 may enter the heat exchange room R1 through the inlet 110*a*.

The outlet 120*b* may communicate the inside of the cabinet 100 with the outside. Upon driving of the blow fan 16 which will be described below, inside air of the cabinet 100 may be discharged to the outside of the cabinet 100 through the outlet 120*b*. For example, the outlet 120*b* may communicate the heat exchange room R1 with the outside of the cabinet 100, and upon driving of the blow fan 16, inside air of the heat exchange room R1 may be discharged to the outside of the outdoor unit 10 through the outlet 120*b*.

The outlet 120*b* may be positioned behind the inlet 110*a*. To improve heat exchange efficiency, the outlet 120*b* may be positioned to correspond to the heat exchanger 11. For example, at least one portion of the outlet 120*b* may be formed by the rear frame 120. In the cabinet 100, the outlet 120*b* may be positioned variously according to a shape, a position, etc., of the heat exchanger 11.

The heat exchanger 11 may exchange heat with outside air. A refrigerant may flow through the heat exchanger 11. In the heat exchanger 11, heat exchange between a refrigerant and outside air may occur.

For example, during a cooling operation of the air conditioner 1, a high-pressure and high-temperature refrigerant gas may be condensed in the heat exchanger 11, and while the refrigerant is condensed, the refrigerant may emit heat to indoor air. During the cooling operation of the air conditioner 1, the heat exchanger 11 may discharge a refrigerant liquid.

Also, during a heating operation of the air conditioner 1, a low-temperature and low-pressure refrigerant liquid may be evaporated in the heat exchanger 11, and while the refrigerant is evaporated, the refrigerant may absorb heat from indoor air. During the heating operation of the air conditioner 1, the heat exchanger 11 may discharge a refrigerant gas.

The heat exchanger 11 may be positioned inside the cabinet 100. More specifically, the heat exchanger 11 may be positioned in the heat exchange room R1. The heat exchanger 11 may be positioned between the inlet 110*a* and the outlet 120*b*. The heat exchanger 11 may be supported by the base 140. The heat exchanger 11 may be positioned above the base 140.

The compressor 12 may compress a refrigerant gas and discharge a high-temperature and high-pressure refrigerant gas. For example, the compressor 12 may include a motor and a compression mechanism, and the compression mechanism may compress the refrigerant gas by a torque of the motor.

The compressor 12 may be positioned inside the cabinet 100. More specifically, the compressor 12 may be positioned in the machine room R2. The compressor 12 may be supported by the base 140.

The outdoor unit 10 according to an embodiment of the disclosure may further include the refrigerant pipe 40. The refrigerant pipe 40 may be connected to the compressor 12, the heat exchanger 11, the expander, etc. In the refrigerant pipe 40, a refrigerant flowing through the compressor 12, the heat exchanger 11, and the expander may flow. The refrigerant pipe 40 may be positioned inside the cabinet 100. For example, the refrigerant pipe 40 may be positioned in the machine room R2.

The outdoor unit 10 may include the blow fan 16 configured to generate air current. Upon driving of the blow fan 16, a suction force may be generated, and air may enter the inside of the cabinet 100 through the inlet 110*a*, then pass through the heat exchanger 11, and be discharged to the outside of the cabinet 100 through the outlet 120*b*.

The blow fan 16 may be positioned inside the cabinet 100. More specifically, the blow fan 16 may be positioned in the heat exchange room R1. The blow fan 16 may be positioned between the inlet 110*a* and the outlet 120*b*. The blow fan 16 may be positioned between the inlet 110*a* and the heat exchanger 11.

According to a rotation of the blow fan 16, air may flow from a front area of the blow fan 16 toward a rear area of the blow fan 16.

The outdoor unit 10 may include a motor bracket 18 supporting the blow fan 16. For example, the motor bracket 18 may support a fan motor (not shown). The motor bracket 18 may support the blow fan 200 from behind.

The motor bracket 18 may be positioned inside the cabinet 100. The motor bracket 18 may be positioned in the heat exchange room R1. For example, the motor bracket 18 may be positioned between the inlet 110*a* and the heat exchanger 11.

The motor bracket 18 may be supported by the cabinet 100. For example, the motor bracket 18 may be fixed to the base 140. For example, the motor bracket 18 may be fixed to the front panel 110.

The outdoor unit 10 according to an embodiment of the disclosure may include an electric component 13 and component rooms 230 and 240 accommodating the electric component 13.

The electric component 13 may control the components of the outdoor unit 10. For example, the electric component 13 may control driving of the heat exchanger 11, the compressor 12, and the blow fan 16.

The electric component 13 may include a first electric component 13*a* and a second electric component 13*b*. The first electric component 13*a* may be positioned at a front area of the cabinet 100, and the second electric component 13*b* may be positioned at a side area of the cabinet 100.

The component rooms 230 and 240 may be provided to one side of the machine room R2. The component rooms 230 and 240 may be positioned above a component such as the compressor 12 inside the cabinet 100. However, positions of the component rooms 230 and 240 are not limited to the above example.

The component rooms 230 and 240 may include a first component room 230 positioned at the front area of the cabinet 100 and a second component room 240 provided at the side area of the cabinet 100. The first electric component 13*a* may be accommodated in the first component room 230, and the second electric component 13*b* may be accommodated in the second component room 240.

The outdoor unit 10 according to an embodiment of the disclosure may include component room cases 210 and 220. The component room cases 210 and 220 may further include a first case 210 and a second case 220.

The first case 210 may form the first component room 230, and the second case 220 may form the second component room 240. The first case 210 may be positioned in the front area of the cabinet 100, and the second case 220 may be positioned in the side area of the cabinet 100. The first case 210 and the second case 220 may be positioned above a component such as the compressor 12. However, positions of the first case 210 and the second case 220 are not limited to the above examples.

The first case 210 may be coupled to the second case 220. The first case 210 may be screw-coupled to the second case 220.

The outdoor unit 10 may include case covers 250 and 260. The case covers 250 and 260 may further include a first cover 250 and a second cover 260.

The first cover 250 may be coupled to a front portion of the first case 210, and the second cover 260 may be coupled to a side portion of the second case 220. The first cover 250 may open or close the first case 210, and the second cover 260 may open or close the second case 220. The first cover 250 may cover the first component room 230, and the second cover 260 may cover the second component room 240.

The outdoor unit 10 may further include a guide 300, a duct 170, and the hose 190.

The guide 300 may be positioned below the first and second cases 210 and 220. The guide 300 may guide a wire 50 positioned in the machine room R2 (see FIGS. 8 and 9). The guide 300 may also be referred to as a wire guide 300. The guide 300 may be formed by injection molding. Details about the guide 300 will be described below.

The duct 170 may be positioned between the first case 210 and the second case 220. The duct 170 may be positioned behind the first case 210. The duct 170 may communicate the heat exchange room R1 with the component rooms 230 and 240. The duct 170 may also be referred to as a guide duct 170.

The hose 190 may be connected to the second case 220. The hose 190 may be positioned below the second case 220. The hose 190 may guide a refrigerant to flow from the second component room 240 to the outside of the cabinet 100. The hose 190 may discharge a refrigerant existing in the component rooms 230 and 240 to the outside of the cabinet 100. The hose 190 may be referred to as a discharge hose 190.

Figure 5:
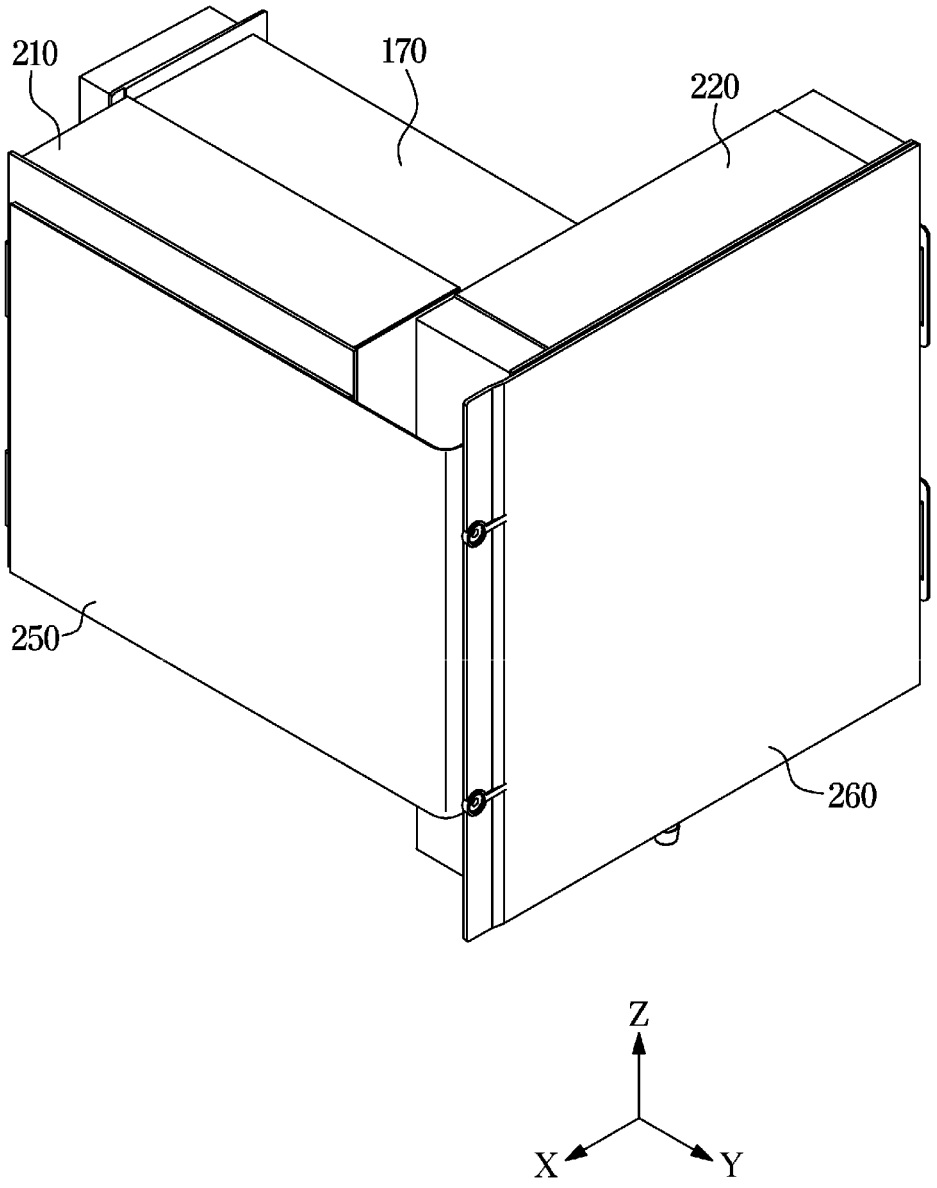
FIG. 5 is a perspective view showing some components of an outdoor unit of an air conditioner according to an embodiment of the disclosure.
Figure 6:
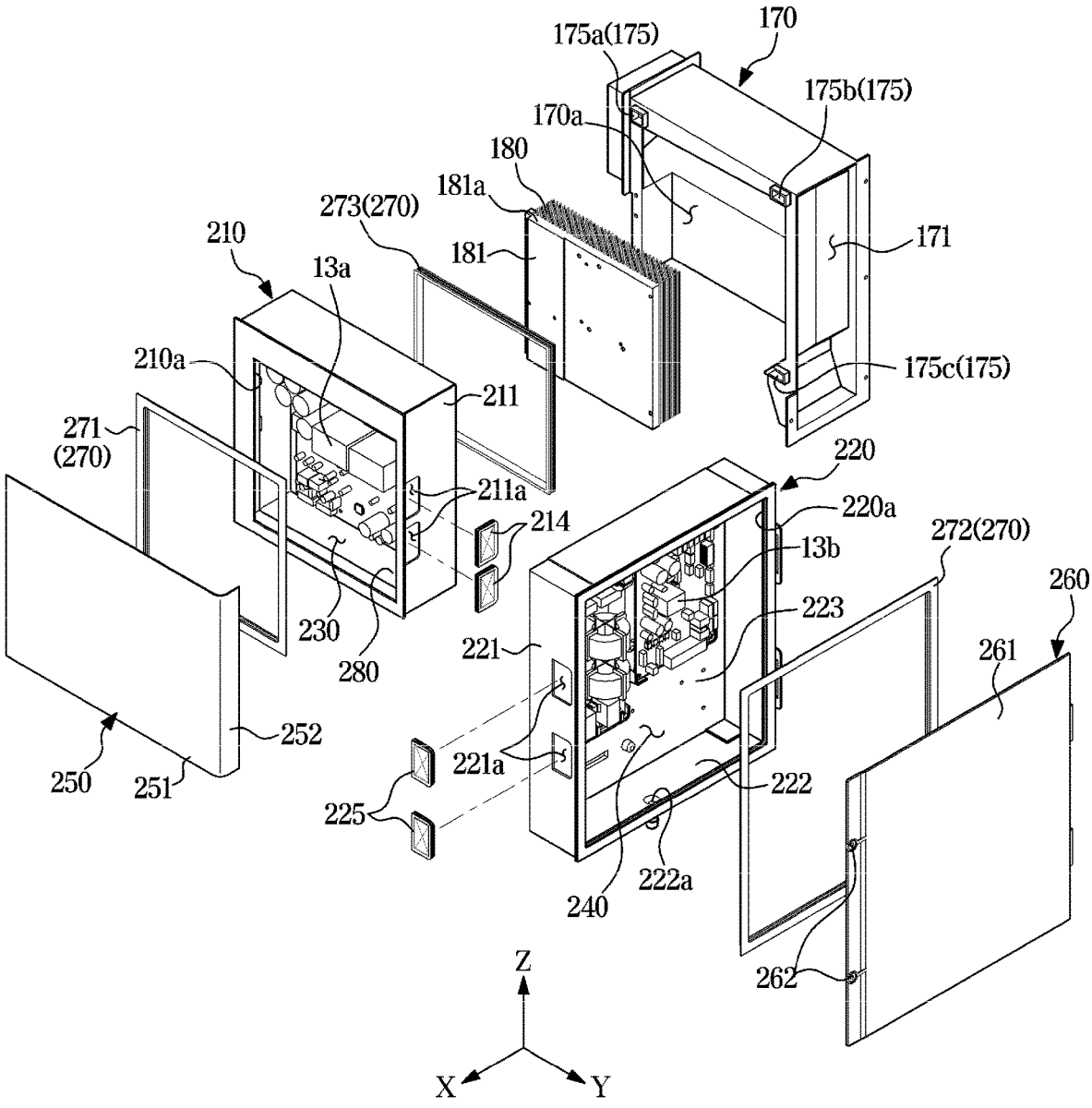
FIG. 6 is an exploded perspective view showing some components of an outdoor unit of an air conditioner according to an embodiment of the disclosure.

FIG. 5 is a perspective view showing some components of an outdoor unit of an air conditioner according to an embodiment of the disclosure. FIG. 6 is an exploded perspective view showing some components of an outdoor unit of an air conditioner according to an embodiment of the disclosure.

Referring to FIGS. 5 and 6, the outdoor unit 10 according to an embodiment of the disclosure may include the component room cases 210 and 220 that form the component rooms 230 and 240 accommodating the electric components 13*a* and 13*b* and have openings 210*a* and 220*a* in first sides.

The outdoor unit 10 according to an embodiment of the disclosure may include the case covers 250 and 260 positioned in the first sides of the component room cases 210 and 220 to cover the openings 210*a* and 220*a* of the component room cases 210 and 220.

The component room cases 210 and 220 may include the first case 210 and the second case 220. Also, the case covers 250 and 260 may include the first cover 250 and the second cover 260.

The outdoor unit 10 according to an embodiment of the disclosure may include the first case 210, a first opening 210*a*, a first wire hole 211*a*, a first sealing member 214, and the first cover 250.

The first case 210 may form the first component room 230. The first electric component 13*a* may be positioned inside the first case 210. An electric component box 280 accommodating the first electric component 13*a* may be positioned inside the first case 210. The electric component box 280 may be accommodated in the first case 210.

The first case 210 may be positioned in front of a heat exchange fin 180, a heat transfer member 181, and the guide duct 170. Also, the first case 210 may be positioned to one side of the second case 220 and the second cover 260. However, a position of the first case 210 is not limited to the above example.

The first wire hole 211*a* may be formed in the first case 210. The first wire hole 211*a* may be formed in a first wall 211 of the first case 210. For example, the first wire hole 211*a* may be formed in a side wall 211 of the first case 210 in the Y direction. The wire 50 connected to the first electric component 13*a* may pass through the first wire hole 211*a*. The wire 50 may connect components of the outdoor unit 10, such as the compressor 12 and the heat exchanger 11, to the electric component 13. A position of the first wire hole 211*a* in the first case 210 is not limited to the above example, and the first wire hole 211*a* may be formed at various positions to connect the first electric component 13*a* to the wire 50.

The first case 210 may have the opening 210*a*. The opening 210*a* of the first case 210 may be the first opening 210*a*. The first opening 210*a* may be formed in the first side of the first case 210. For example, the first side of the first case 210 may be a front portion of the first case 210. The first opening 210*a* may be opened or closed by the first cover 250. The first electric component 13*a* may be inserted into or taken out of the first case 210 through the first opening 210*a*.

The first sealing member 214 may be positioned in the first wire hole 211*a*. The first sealing member 214 may prevent any unnecessary fluid, dust, etc., from entering inside of the first component room 230. The first sealing member 214 may be coupled to the first case 210.

Figure 12:
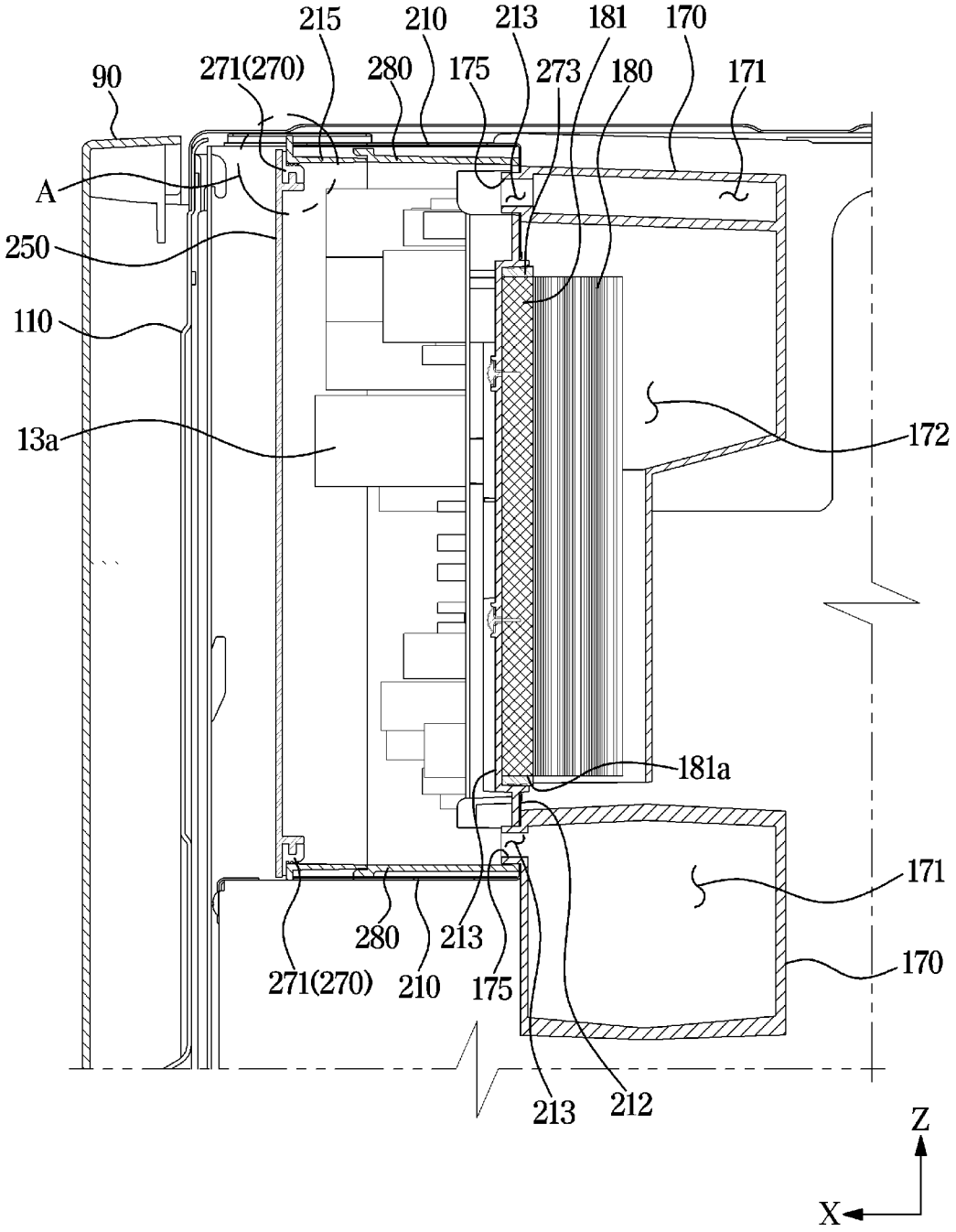
FIG. 12 is a cross-sectional view of an outdoor unit of an air conditioner according to an embodiment of the disclosure.

The outdoor unit 10 of the air conditioner 1 may include a first duct hole 213 in a second wall 212 of the first case 210 (see FIG. 12).

The first cover 250 may be positioned in the first side of the first case 210. For example, the first cover 250 may be coupled to the front portion of the first case 210. The first cover 250 may open or close the first case 210. The first cover 250 may cover the front portion of the first case 210 to protect the electric component box 280 and the first electric component 13*a*.

The first cover 250 may include a cover portion 251 and a bent portion 252. The cover portion 251 may extend in a side direction to cover the first component room 230. The bent portion 252 may be bent from an end in side direction of the cover portion 251 toward a rear direction. The bent portion 252 may couple the first cover 250 to the second cover 260.

The outdoor unit 10 according to an embodiment of the disclosure may include the second case 220, a second opening 220*a*, a second wire hole 221*a*, a hose hole 222*a*, a second sealing member 225, and the second cover 260.

The second case 220 may form the second component room 240. The second electric component 13*b* may be positioned inside the second case 220.

The second wire hole 221*a* may be formed in the second case 220. The second wire hole 221*a* may be formed in a first wall 221 of the second case 220. For example, the second wire hole 221*a* may be formed in a front wall 221 of the second case 220 in the X direction. The second wire hole 221*a* may pass the wire 50 connected to the second electric component 13*b* therethrough. The wire 50 may connect components of the outdoor unit 10, such as the compressor 12 and the heat exchanger 11, to the electric component 13. A position of the second wire hole 221*a* in the second case 220 is not limited to the above example, and the second wire hole 221*a* may be formed at various positions to connect the first electric component 13*a* to the wire 50.

The second case 220 may have the opening 220*a*. The opening 220*a* of the second case 220 may be the second opening 220*a*. The second opening 220*a* may be formed in a first side of the second case 220. For example, the first side of the second case 220 may be the side portion of the second case 220. The second opening 220*a* may be opened or closed by the second cover 260. The second electric component 13*b* may be inserted into or taken out of the second case 220 through the second opening 220*a*.

The second sealing member 225 may be positioned in the second wire hole 221*a*. The second sealing member 225 may prevent any unnecessary fluid, dust, etc., from entering inside of the second component room 240. The second sealing member 225 may be coupled to the second case 220.

The hose hole 222*a* may be connected to the discharge hose 190 to allow a refrigerant existing in the component rooms 230 and 240 to flow to the outside of the cabinet 100. The hose hole 222*a* may be connected to the second discharge hole 121*a* formed in the rear panel 121 of the cabinet 100 through the discharge hose 190. The hose hole 222*a* may be formed in a bottom 222 of the second case 220. A position of the hose hole 222*a* is not limited to the above example. The hose hole 222*a* may be referred to as a discharge hole 222*a*. For example, the hose hole 222*a* may be referred to as a fifth discharge hole 222*a*.

Figure 13:
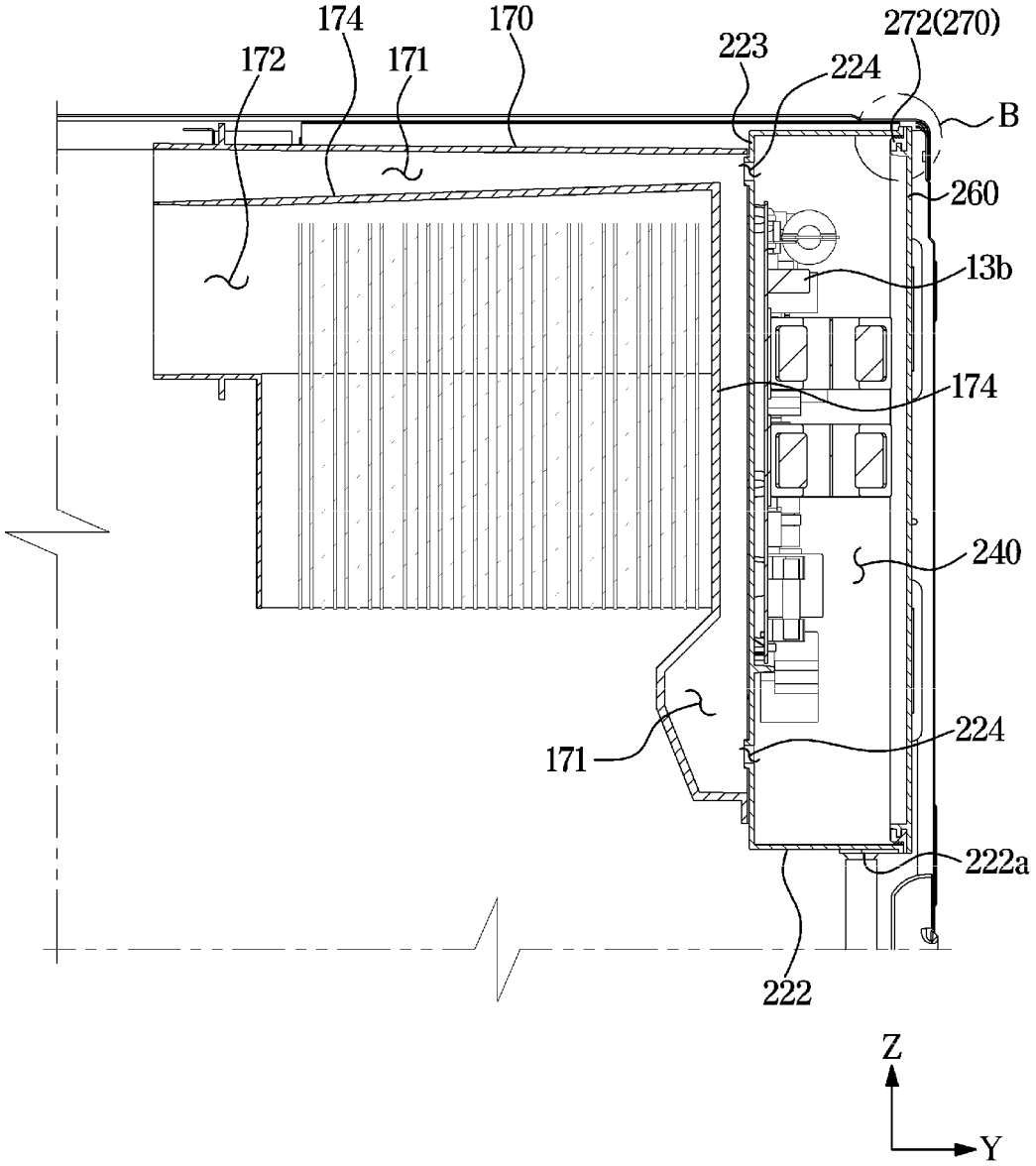
FIG. 13 is a cross-sectional view of an outdoor unit of an air conditioner according to an embodiment of the disclosure.

A second duct hole 224 may be formed in a second wall 223 of the second case 220 (see FIG. 13).

The second cover 260 may be positioned in the first side of the second case 220. For example, the second cover 260 may be coupled to the side portion of the second case 220. The second cover 260 may open or close the second case 220. The second cover 260 may cover the side portion of the second case 220 to protect the second electric component 13*b*.

The second cover 260 may include a cover portion 261 and a coupling portion 262. The cover portion 261 of the second cover 260 may cover the second opening 220*a*. The coupling portion 262 may be provided at one end of a front portion of the second cover 260 to couple the second cover 260 to the first cover 250. A screw (not shown) may be coupled to the coupling portion 262.

The outdoor unit 10 according to an embodiment of the disclosure may include sealing members 271, 272, and 273 positioned between the component room cases 210 and 220 and the case covers 250 and 260.

Sealing members 271, 272, and 273 may include a first sealing member 271 for sealing between the first case 210 and the first cover 250, a second sealing member 272 for sealing between the second case 220 and the second cover 260, and a third sealing member 273 for sealing between the electric component box 280 and the heat transfer member 181.

The first sealing member 271 may be positioned between the first case 210 and the first cover 250 in the front-rear direction. For example, the first sealing member 271 may be positioned at a circumference portion of the first opening 210*a*.

The second sealing member 272 may be positioned between the second case 220 and the second cover 260 in the front-rear direction. For example, the second sealing member 272 may be positioned at a circumference portion of the second opening 220*a*.

The third sealing member 273 may be positioned at a circumference of the heat exchange member 181 to seal between the electric component box 280 and the heat transfer member 181.

The outdoor unit 10 according to an embodiment of the disclosure may include the duct 170 connected to the heat exchange room R1 and positioned in second sides of the component room cases 210 and 220. The duct 170 may be referred to as a guide duct 170.

The guide duct 170 may be positioned in the second sides of the first case 210 and the second case 220. For example, the guide duct 170 may be positioned behind the first case 210 and to a side of the second case 220. The guide duct 170 may be positioned between the first case 210 and the second case 220. The guide duct 170 may communicate the heat exchange room R1 with the component rooms 230 and 240.

The guide duct 170 may form an accommodating space 170*a* and an internal flow path 171. The heat exchange fin 180 and the heat transfer member 181 may be accommodated in the accommodating space 170*a*. The accommodating space 170*a* may be formed inside the internal flow path 171. According to coupling of the first case 210, the heat transfer member 181, the heat exchange fin 180, and the guide duct 170, the accommodating space 170*a* may form a part of a cooling flow path 172. The accommodating space 170*a* may be connected to the machine room R2.

The cooling flow path 172 may be connected to the heat exchange room R1 and the machine room R2. The cooling flow path 172 may enable air to pass through the heat exchange fin 180 and flow to the outside of the cabinet 100, thereby discharging heat generated in the electric component 13 to the outside of the cabinet 100.

The guide duct 170 may include a vent 175. The vent 175 may enable inside air of the guide duct 170 to flow to the first component room 230 or inside air of the first component room 230 to flow to the guide duct 170.

The vent 175 may protrude toward the front direction. The vent 175 may be inserted into the first case 210. The vent 175 may be formed to correspond to the first duct hole 213 formed in the first case 210. For example, the vent 175 may be inserted in the first duct hole 213.

A plurality of vents 175 may be provided. The plurality of vents 175 may include a first vent 175*a*, a second vent 175*b*, and a third vent 175*c*. The first vent 175*a* may be provided at a right and upper end of the guide duct 170, the second vent 175*b* may be provided at a left and upper end of the guide duct 170, and the third vent 175*c* may be provided at a left and lower end of the guide duct 170.

The outdoor unit 10 may further include the heat exchange fin 180, the heat transfer member 181, and the third sealing member 273.

The heat exchange fin 180 may be coupled to the heat transfer member 181. The heat exchange fin 180 and the heat transfer member 181 may be accommodated in the accommodating space 170*a* of the guide duct 170. The heat exchange fin 180 and the heat transfer member 181 may be installed in the first case 210 and the electric component box 280.

The heat transfer member 181 may be in contact with the electric component box 280 to receive heat generated from the first electric component 13*a* and transfer the heat to the heat exchange fin 180. The heat exchange fin 180 may perform heat exchange with air on the cooling flow path 172 to discharge heat generated in the first electric component 13*a* to the outside of the cabinet 100. The electric component box 280 may be positioned along a circumference 181*a* of the heat transfer member 181. The heat transfer member 181 may be inserted in the electric component box 280 (see FIG. 12).

The third sealing member 273 may be positioned between the heat transfer member 181 and the electric component box 280. For example, the third sealing member 273 may be positioned along the circumference 181*a* of the heat transfer member 181 (see FIG. 12).

The outdoor unit 10 according to an embodiment of the disclosure may include the duct holes 213 and 224 formed in the second sides of the component room cases 210 and 220 to connect the electric component cases 210 and 220 to the duct 170.

Inside air of the component rooms 230 and 240 may flow to the outside of the cabinet 100 through the duct holes 213 and 224.

Figure 7:
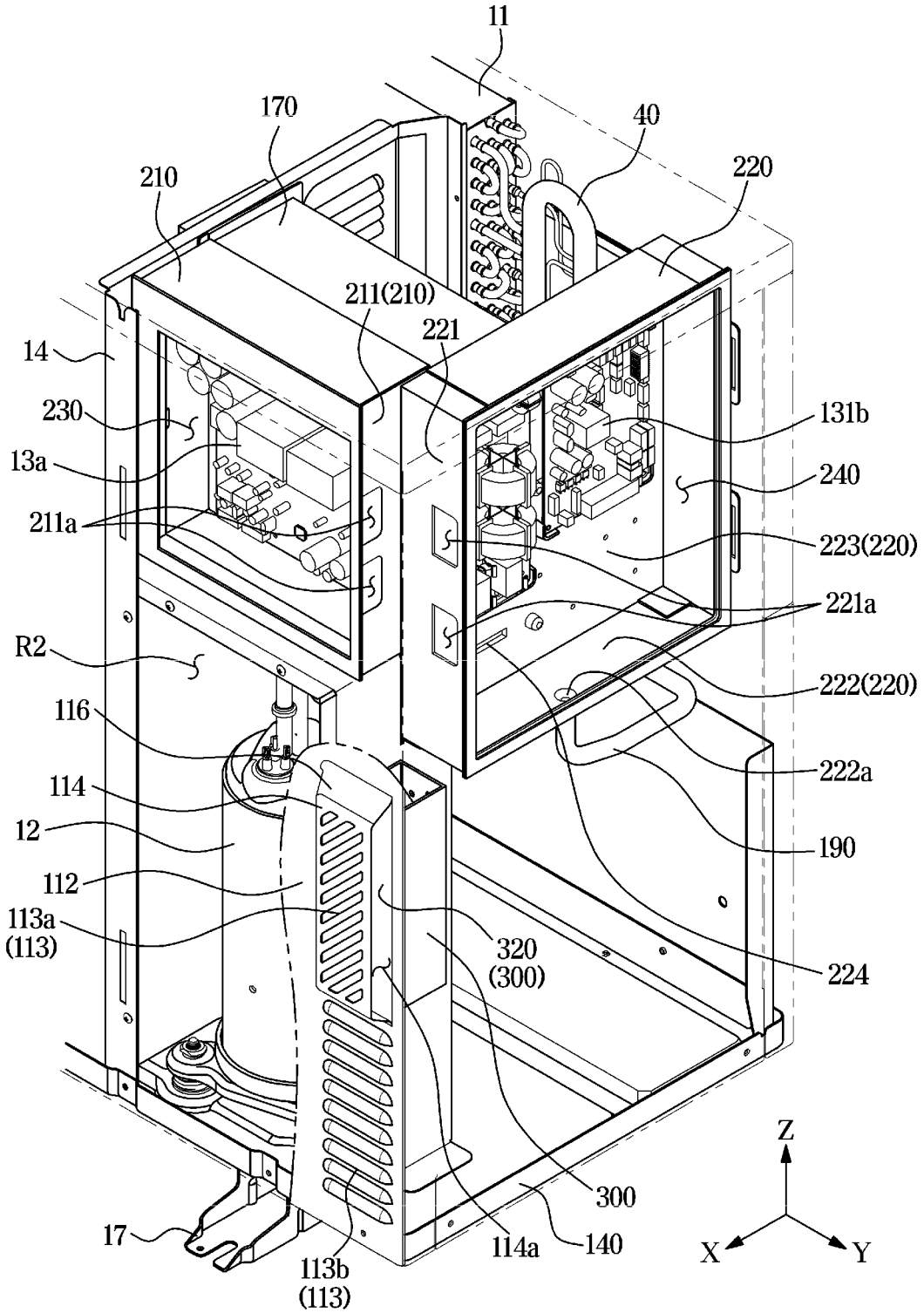
FIG. 7 is an enlarged perspective view of a portion of an outdoor unit of an air conditioner according to an embodiment of the disclosure.
Figure 8:
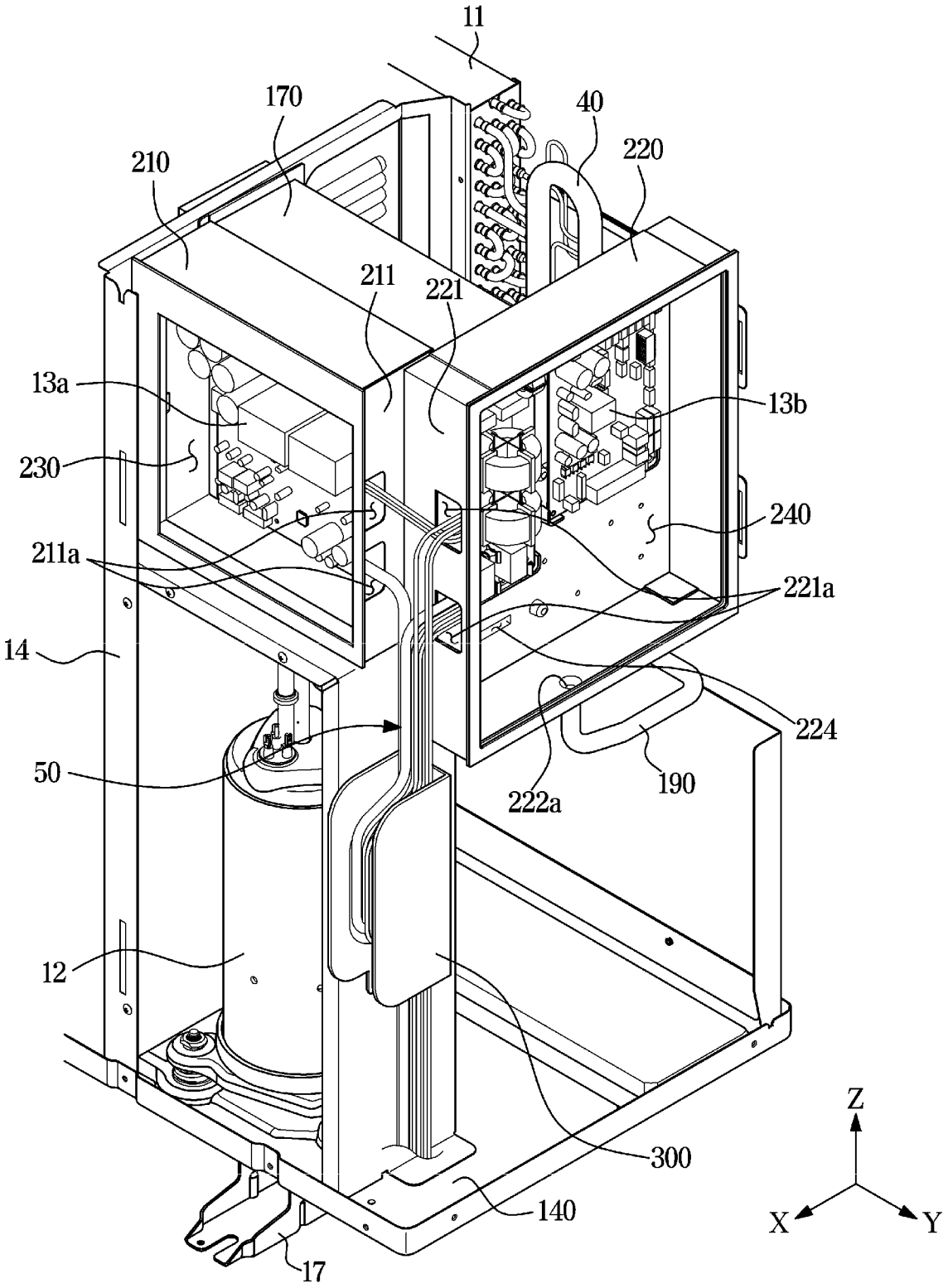
FIG. 8 is a perspective view of the outdoor unit shown in FIG. 7 after a portion of a cabinet is removed from the outdoor unit.
Figure 9:
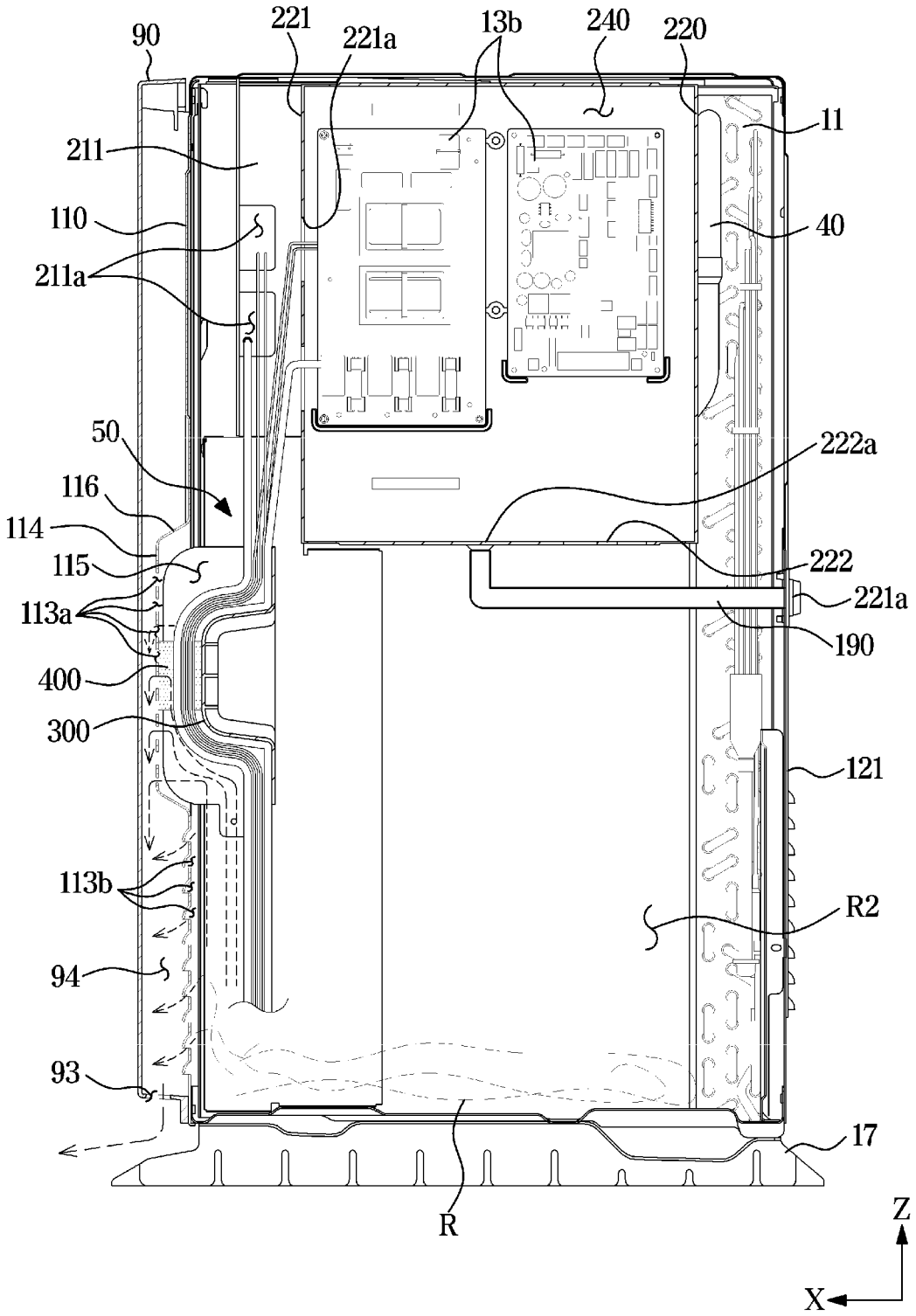
FIG. 9 is a cross-sectional view of an outdoor unit of an air conditioner according to an embodiment of the disclosure.

FIG. 7 is an enlarged perspective view of a portion of an outdoor unit of an air conditioner according to an embodiment of the disclosure. FIG. 8 is a perspective view of the outdoor unit shown in FIG. 7 after a portion of a cabinet is removed from the outdoor unit. FIG. 9 is a cross-sectional view of an outdoor unit of an air conditioner according to an embodiment of the disclosure. FIG. 9 is a cross-sectional view of the outdoor unit of FIG. 2, taken along line A-A'.

Referring to FIGS. 7 to 9, the outdoor unit 10 according to an embodiment of the disclosure may include the first discharge hole 113 provided in the front panel 110. For example, the first discharge hole 113 may be formed in the second panel portion 112 of the front panel 110 in correspondence to the machine room R2. The first discharge hole 113 may extend from the middle part of the second panel portion 112 to the lower part of the second panel portion 112. A position of the first discharge hole 113 is not limited to the above example, and the first discharge hole 113 may be formed in the side panel 130 and/or the rear panel 121 as long as a refrigerant existing in the machine room R2 is smoothly discharged through the first discharge hole 113, which will be described below.

The first discharge hole 113 may include the first part 113*a* and the second part 113*b*. The first part 113*a* may be positioned above the second part 113*b* and formed in the protrusion portion 114. The second part 113*b* may be positioned below the first part 113*a*.

The front panel 110 may include the inclined portion 116 and the protrusion portion 114.

The inclined portion 116 may protrude from the second panel portion 112 toward the protrusion portion 114.

The protrusion portion 114 may protrude toward the front direction to correspond to a shape of the guide 300 which will be described below. The protrusion portion 114 may have a step with respect to the second panel portion 112. In the protrusion portion 114, the first part 113*a* of the first discharge hole 113 may be formed. Also, the protrusion hole 114*a* may be formed at the sides of the protrusion portion 114 and the inclined portion 116. The protrusion hole 114*a* may be covered by the guide 300. For example, the protrusion hole 114*a* may be covered by a panel portion 320 of the guide 300.

Inside the cabinet 100, the wire 50 electrically connecting various components of the outdoor unit 10, such as the compressor 12 and the heat exchanger 11, to the electric component 13 may be positioned. For example, the wire 50 may be positioned inside the machine room R2, and inserted in the first component room 230 and the second component room 240 through the guide 300. A plurality of bundles of wire 50 may be tied in a lower and front area of the machine room R2 and guided to the component rooms 230 and 240 through the guide 300.

The wire 50 may be inserted in the first component room 230 through the first wire hole 211*a* of the first case 210 and connected to the first electric component 13*a*. Also, the wire 50 may be inserted in the second component room 240 through the second wire hole 221*a* of the second case 220 and connected to the second electric component 13*b*.

The guide 300 may be positioned below the first case 210 and the second case 220 to guide the wire 50 to the component rooms 230 and 240. The guide 300 may be positioned adjacent to the front panel 110 to guide a refrigerant to be discharged through the first discharge hole 113 formed in the front panel 110. For example, the guide 300 may be positioned in front of the second case 220 to guide the refrigerant and the wire 50. The guide 300 may be referred to as a refrigerant guide 300.

The guide 300 may be detachably coupled to the cabinet 100 inside the cabinet 100. The guide 300 may guide the wire 50 and discharge any refrigerant collected inside the cabinet 100 to the outside of the cabinet 100, thereby preventing risks of a fire and explosion of the outdoor unit 10.

The outdoor unit 10 according to an embodiment of the disclosure may further include a blocking member 400. The blocking member 400 may be positioned between the guide 300 and the front panel 110. For example, the blocking member 400 may be positioned between a protrusion portion 340 of the guide 300 and the protrusion portion 114 of the front panel 110. The blocking member 400 may block a refrigerant R collected upward from the lower portion of the machine room R2. However, the blocking member 400 may be formed of a material having elasticity to pass the wire 50 therethrough. For example, the blocking member 400 may include a sponge. The blocking member 400 may be referred to as an elastic member 400.

In the outdoor unit 10 according to an embodiment of the disclosure, the refrigerant pipe 40 connecting the compressor 12, the heat exchanger 11, the expander, etc. to each other may be positioned inside the machine room R2. At portions of the refrigerant pipe 40, which are coupled to the compressor 12, the heat exchanger 11, and the expander, welds of the refrigerant pipe 40, and/or the refrigerant pipe 40, refrigerant leakage may occur. Upon occurrence of refrigerant leakage, a leaking refrigerant may be collected in the cabinet 100 or the machine room R2. For example, a refrigerant such as R290 that is heavier than air may be collected in the cabinet 100 or the machine room R2.

In a case in which a refrigerant is continuously accumulated inside the machine room R2 without being discharged to the outside of the cabinet 100, the refrigerant may flow to the component rooms 230 and 240 positioned in the upper area of the cabinet 100. The refrigerant arrived at the component rooms 230 and 240 may cause a fire or explosion by reacting with sparks, etc., which are occasionally generated in the electric component 13, due to reactivity of the refrigerant. Accordingly, before a refrigerant is collected to flow to the component rooms 230 and 240, the refrigerant may need to be discharged to the outside of the cabinet 100. Particularly, because the wire 50 is guided in the front area of the machine room R2 and connected to the electric component 13 inside the component rooms 230 and 240, the refrigerant may enter the component rooms 230 and 240 through the first wire hole 211*a* and the second wire hole 221*a* through which the wire 50 is inserted in the first case 210 and the second case 220. The above-described sealing members 214 and 225 may reduce an amount of a refrigerant entering the component rooms 230 and 240, and nevertheless, a refrigerant may enter the component rooms 230 and 240 because the refrigerant is a fluid.

To prevent such a fire or explosion, the outdoor unit 10 according to an embodiment of the disclosure may discharge the refrigerant to the outside of the cabinet 100 through the discharge holes 113, 121*a*, 121*b*, and 132*a* before the refrigerant is collected and flows to the component rooms 230 and 240. As shown in FIGS. 2 to 4, because the outdoor unit 10 includes the plurality of discharge holes 113, 121*a*, 121*b*, and 132*a* provided in a lower portion of the cabinet 100, the refrigerant may be discharged to the outside of the cabinet 100 without being collected inside the machine room R2.

Because a refrigerant needs to be prevented from flowing to the front area of the machine room R2 to enter the component rooms 230 and 240, a refrigerant existing in the machine room R2 may need to be discharged through the first discharge hole 113 formed in the front panel 110.

Referring to FIG. 9, a refrigerant R collected on a bottom of the machine room R2 may be filled up gradually. However, the refrigerant R existing in the machine room R2 may flow to the outside of the cabinet 100 through the first discharge hole 113 formed in the front panel 110. For example, because the guide 300 protrudes in the front direction, a refrigerant (that is, the refrigerant R flowing upward) flowing toward the component rooms 230 and 240 may be guided to the outside of the front panel 110 from a space 115 between the protrusion portion 340 (see FIG. 10) of the guide 300 and the front panel 110 by the guide 300. The refrigerant R climbed over the front panel 110 and flowing to the outside of the cabinet 100 by the guide 300 may pass through a space 94 between the front panel 110 and the front cover 90 and then be completely discharged from the outdoor unit 10 through a cover hole 93 formed in a lower portion of the front cover 90. Accordingly, because the refrigerant R is discharged to the outside of the cabinet 100 through the first discharge hole 113 before being collected in the machine room R2 and flowing to the component rooms 230 and 240, risks of a fire and explosion of the outdoor unit 10 may be reduced.

A flow path formed by the first discharge hole 113, the space 115 between the guide 300 and the front panel 110, the space 94 between the front panel 110 and the front cover 90, and the cover hole 93 may be referred to as a discharge flow path. Particularly, the discharge flow path may be referred to as a first discharge flow path.

A position of the cover hole 93 is not limited to the above example. Also, the shape of the guide 300 is not limited to that shown in the drawings as long as the refrigerant R existing in the machine room R2 is capable of being smoothly discharged to the outside of the cabinet 100.

Also, although a large amount of refrigerant R is discharged to flow to the component rooms 230 and 240, the refrigerant R existing inside the component rooms 230 and 240 may be discharged to the outside of the cabinet 100 through the guide duct 170 and the hose 190. This will be described below.

Figure 10:
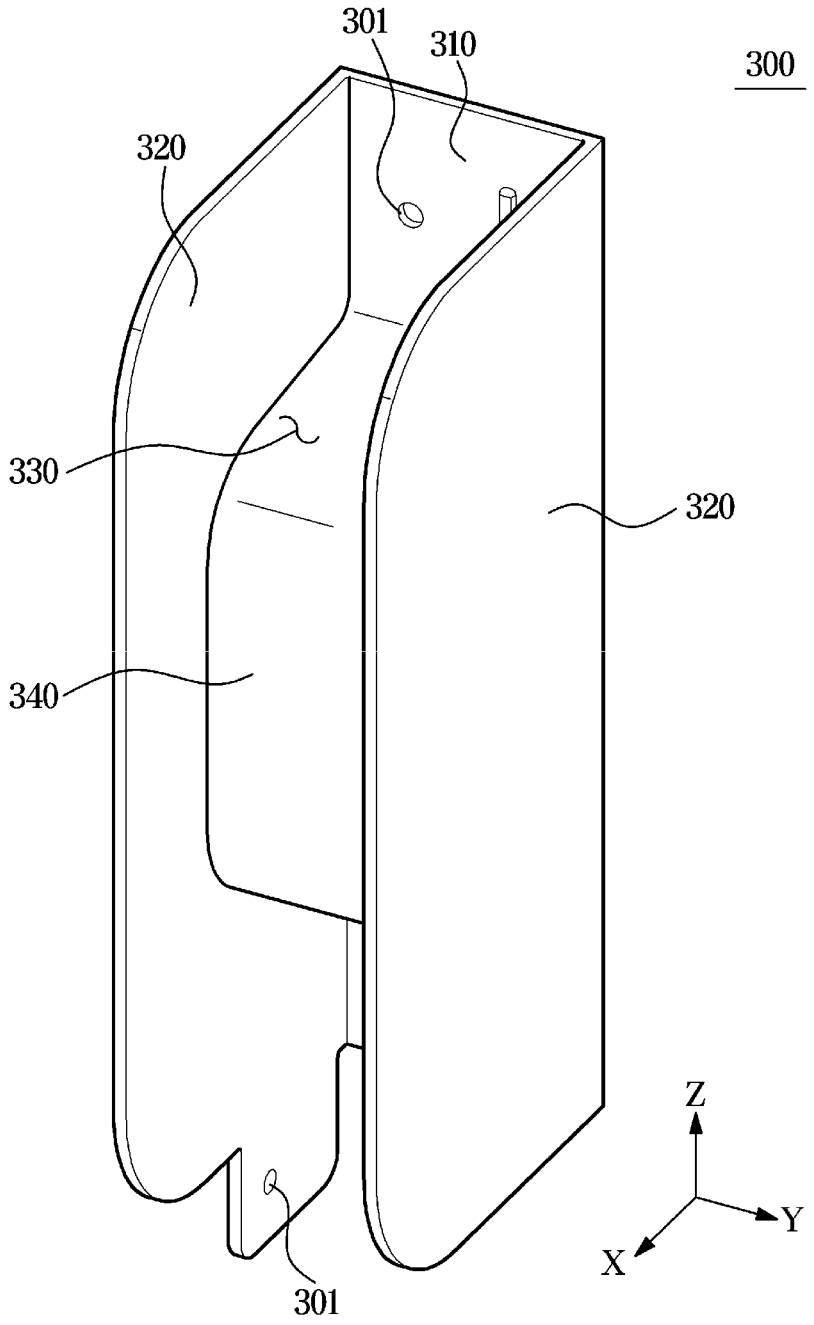
FIG. 10 is a perspective view of a guide in an outdoor unit according to an embodiment of the disclosure.

FIG. 10 is a perspective view of a guide in an outdoor unit according to an embodiment of the disclosure.

Referring to FIG. 10, the guide 300 may guide the wire 50 toward the component rooms 230 and 240. The guide 300 may be detachably coupled to the cabinet 100 inside the cabinet 100. Also, the guide 300 may guide the wire 50 and discharge any refrigerant collected in the machine room R2 to the outside of the cabinet 100, thereby preventing risks of a fire and explosion.

The guide 300 may include a base 310, the panel portion 320, an accommodating portion 330, and the protrusion portion 340.

The base 310 may extend in the up-down direction. A pair of panel portions 320 may be provided. The pair of panel portions 320 may be provided at both sides of the base 310 to form the accommodating portion 330 therebetween. The wire 50 may be accommodated in the accommodating portion 330. The protrusion portion 340 may protrude in one direction from the base 310. For example, the protrusion portion 340 may protrude toward the front direction from the base 310. The protrusion portion 340 may guide a flow of a refrigerant such that the refrigerant is discharged to the first discharge hole 113. The protrusion portion 340 may be formed at a center portion of the base 310.

However, the shape of the guide 300 is not limited to the above example. For example, the guide 300 may extend in the up-down direction without having the protrusion portion 340.

In the guide 300, a coupling hole 301 may be provided. A plurality of coupling holes 301 may be provided. The coupling holes 301 may be provided in the base 310 and the panel portion 320. The coupling holes 301 may be used to install the guide 300 in the cabinet 100. A position of the coupling hole 301 is not limited to the above example.

Figure 11:
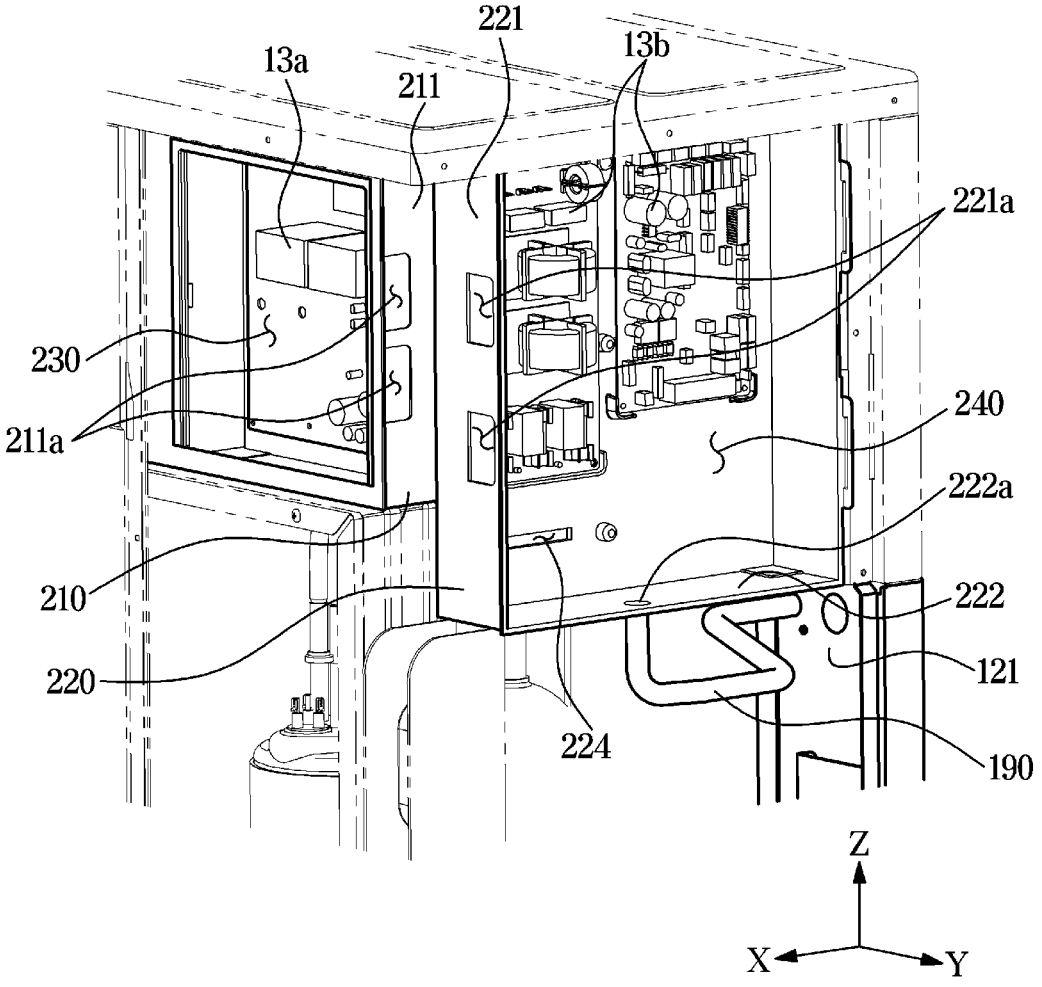
FIG. 11 is a perspective view showing some components of an outdoor unit of an air conditioner according to an embodiment of the disclosure.

FIG. 11 is a perspective view showing some components of an outdoor unit of an air conditioner according to an embodiment of the disclosure. FIG. 12 is a cross-sectional view of an outdoor unit of an air conditioner according to an embodiment of the disclosure. FIG. 13 is a cross-sectional view of an outdoor unit of an air conditioner according to an embodiment of the disclosure. FIG. 13 is a cross-sectional view of the outdoor unit of FIG. 2, taken along line C-C'.

Referring to FIGS. 11 to 13, in the outdoor unit 10 according to an embodiment of the disclosure, a refrigerant R collected on the bottom of the machine room R2 may be filled up gradually. Generally, although a refrigerant existing in the machine room R2 flows to the outside of the cabinet 100 through the discharge holes 113, 121*a*, 121*b*, and 132*a* formed in the cabinet 100, a large amount of refrigerant may be discharged, or discharging a refrigerant through the discharge holes 113, 121*a*, 121*b*, and 132*a* may be not easy. In these cases, the refrigerant may flow to the component rooms 230 and 240 and exist inside the component rooms 230 and 240. Also, due to another reason, a refrigerant may exist inside the component rooms 230 and 240.

In this case, it may be necessary to prevent a fire and/or explosion which is caused by a reaction of the refrigerant with the electric component 13 by rapidly discharging the refrigerant existing inside the component rooms 230 and 240. The outdoor unit 10 according to an embodiment of the disclosure may discharge the refrigerant to the outside of the cabinet 100 through the guide duct 170 and the discharge hose 190.

The discharge hose 190 may be connected to the second case 220. The discharge hose 190 may be connected to the bottom 222 of the second case 220 and the rear panel 121. The discharge hose 190 may be positioned between the second case 220 and the rear panel 121. For example, the discharge hose 190 may be positioned below the second case 220 and in front of the rear panel 121. The discharge hose 190 may be connected to both the second case 220 and the rear panel 121.

The discharge hose 190 may guide a refrigerant moved from the first component room 230 to the second component room 240 to flow from the second component room 240 to the outside of the cabinet 100. The discharge hose 190 may discharge the refrigerant existing inside the component rooms 230 and 240 to the outside of the cabinet 100.

However, a component connecting the second case 220 to the rear panel 121 to discharge a refrigerant from the second component room 240 to the outside of the cabinet 100 is not limited to the discharge hose 190. For example, the discharge hose 190 may be replaced with a discharge pipe, or the discharge hose 190 may be replaced with any one of various components capable of connecting the second component room 240 to the outside of the cabinet 100. The discharge hose 190 may be referred to as a discharge component.

The hose hole 222*a* may be connected to the discharge hose 190 to enable the refrigerant existing inside the component rooms 230 and 240 to flow to the outside of the cabinet 100. The hose hole 222*a* may be connected to the second discharge hole 121*a* formed in the rear panel 121 of the cabinet 100 through the discharge hose 190. The hose hole 222*a* may be formed in a bottom of the second case 220. A position of the hose hole 222*a* is not limited to the above example.

The first component room 230 may communicate with the guide duct 170 through the first duct hole 213. The first duct hole 213 may enable air and/or a refrigerant to flow from the internal flow path 171 formed in the guide duct 170 into the first component room 230, or the first duct hole 213 may enable air and/or a refrigerant to flow from the first component room 230 to the internal flow path 171 formed in the guide duct 170.

The first duct hole 213 may be formed in the second wall 212 of the first case 210. For example, the first duct hole 213 may be formed in the rear wall 212 of the first case 210. A plurality of first duct holes 213 may be provided. The first duct holes 213 may be respectively formed in upper and lower portions of the rear wall 212 of the first case 210.

The vent 175 of the guide duct 170 may be inserted in the first duct hole 213. The first duct hole 213 may be formed to correspond to the guide duct 170.

In the electric component box 280, a hole may be formed to correspond to the first duct hole 213 and the vent 175.

The second component room 240 may communicate with the guide duct 170 through the second duct hole 224. The second duct hole 224 may enable air and/or a refrigerant to flow from the internal flow path 171 formed in the guide duct 170 into the second component room 240, or the second duct hole 224 may enable air and/or a refrigerant to flow from the second component room 240 to the internal flow path 171 formed in the guide duct 170.

The second duct hole 224 may be formed in the second wall 223 of the second case 220. For example, the second duct hole 224 may be formed in the side wall 223 of the second case 220. A plurality of second duct holes 224 may be provided. The second duct holes 224 may be respectively formed in upper and lower portions of the side wall 223 of the second case 220.

The second duct holes 224 may be connected to the internal flow path 171.

The guide duct 170 may be connected to the heat exchange room R1 through a connecting opening 176 at one end in left-right direction of the guide duct 170. The connecting opening 176 may be connected to the heat exchange room R1 in which the blow fan 16 is positioned to move air to inside of the guide duct 170.

In the guide duct 170, the internal flow path 171 and the cooling flow path 172 may be formed. The guide duct 170 may include a partition wall 174 to partition the internal flow path 171 from the cooling flow path 172. The partition wall 174 may extend along the up-down direction and the left-right direction.

Figure 17:
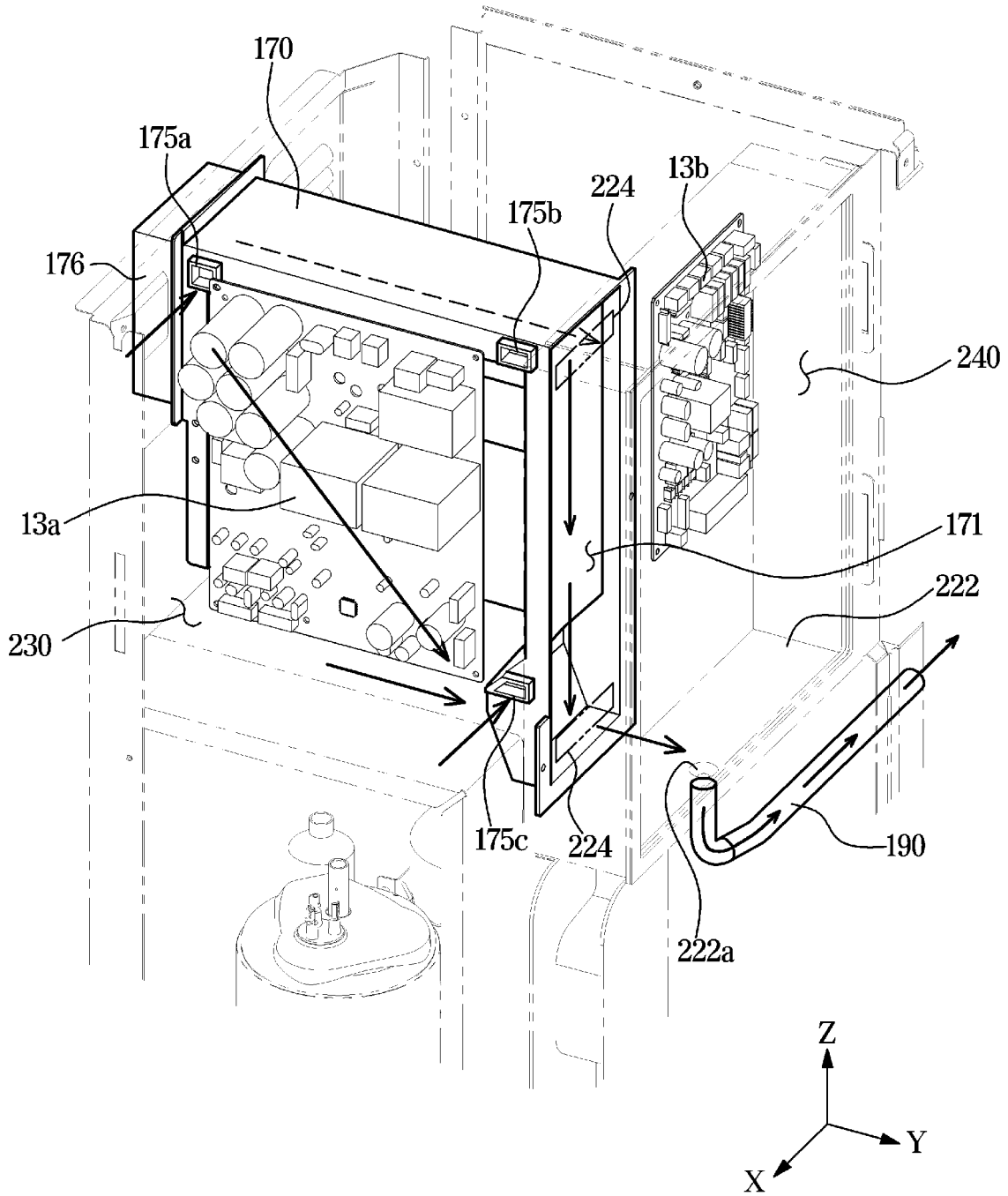
FIG. 17 show flows of air in an outdoor unit of an air conditioner according to an embodiment of the disclosure.

The internal flow path 171 may be connected to the heat exchange room R1 (see FIGS. 4 and 17). The internal flow path 171 may be a path through which air flows from the heat exchange room R1 to the component rooms 230 and 240. The internal flow path 171 may be formed at an upper and side area of the cooling flow path 172.

The internal flow path 171 may be connected to the first component room 230 through the first duct hole 213, and connected to the second component room 240 through the second duct hole 224. Air may freely flow to the heat exchange room R1, the first duct hole 213, the second duct hole 224, and the component rooms 230 and 240 through the internal flow path 171.

Figure 18:
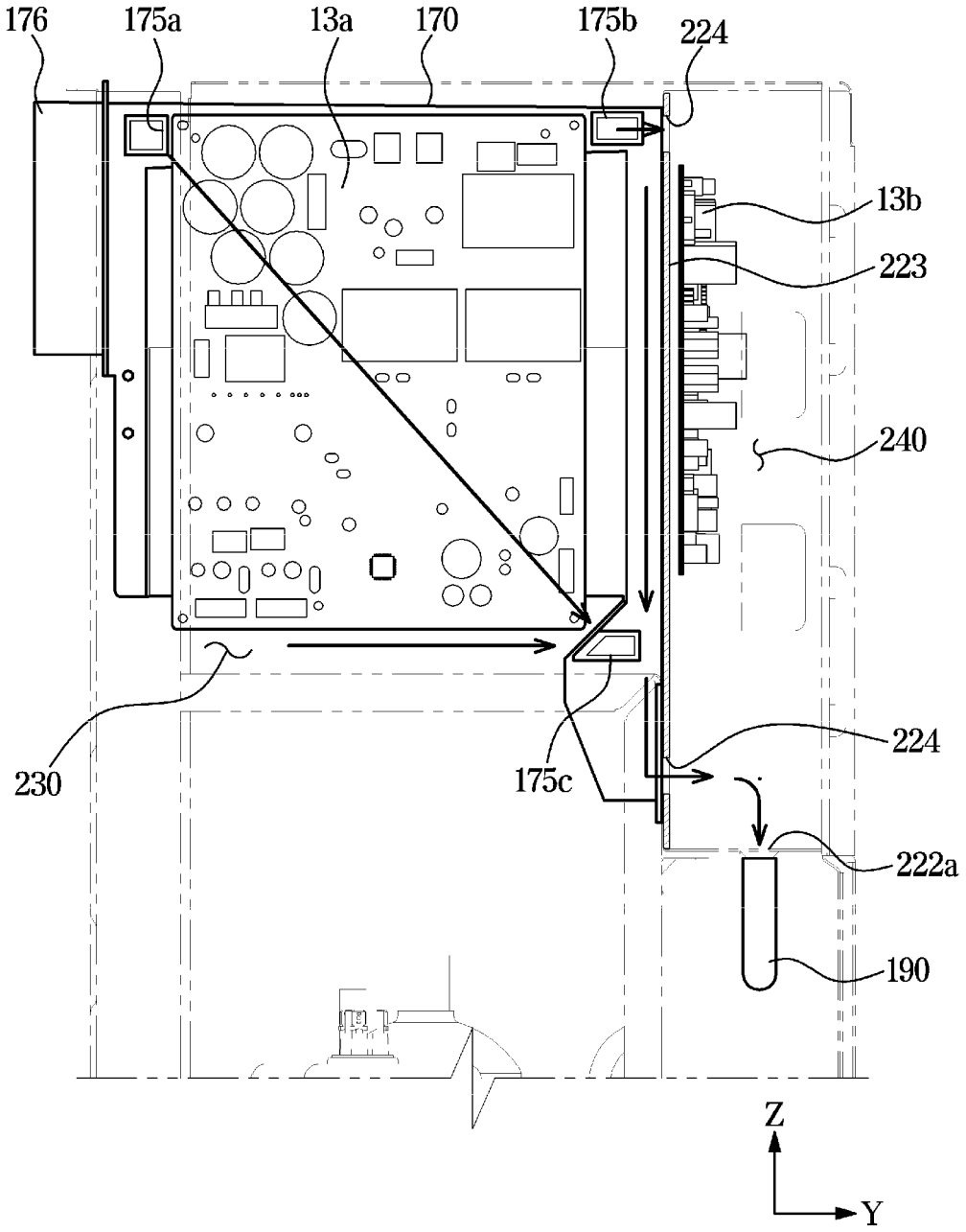
FIG. 18 show flows of air in an outdoor unit of an air conditioner according to an embodiment of the disclosure.
Figure 19:
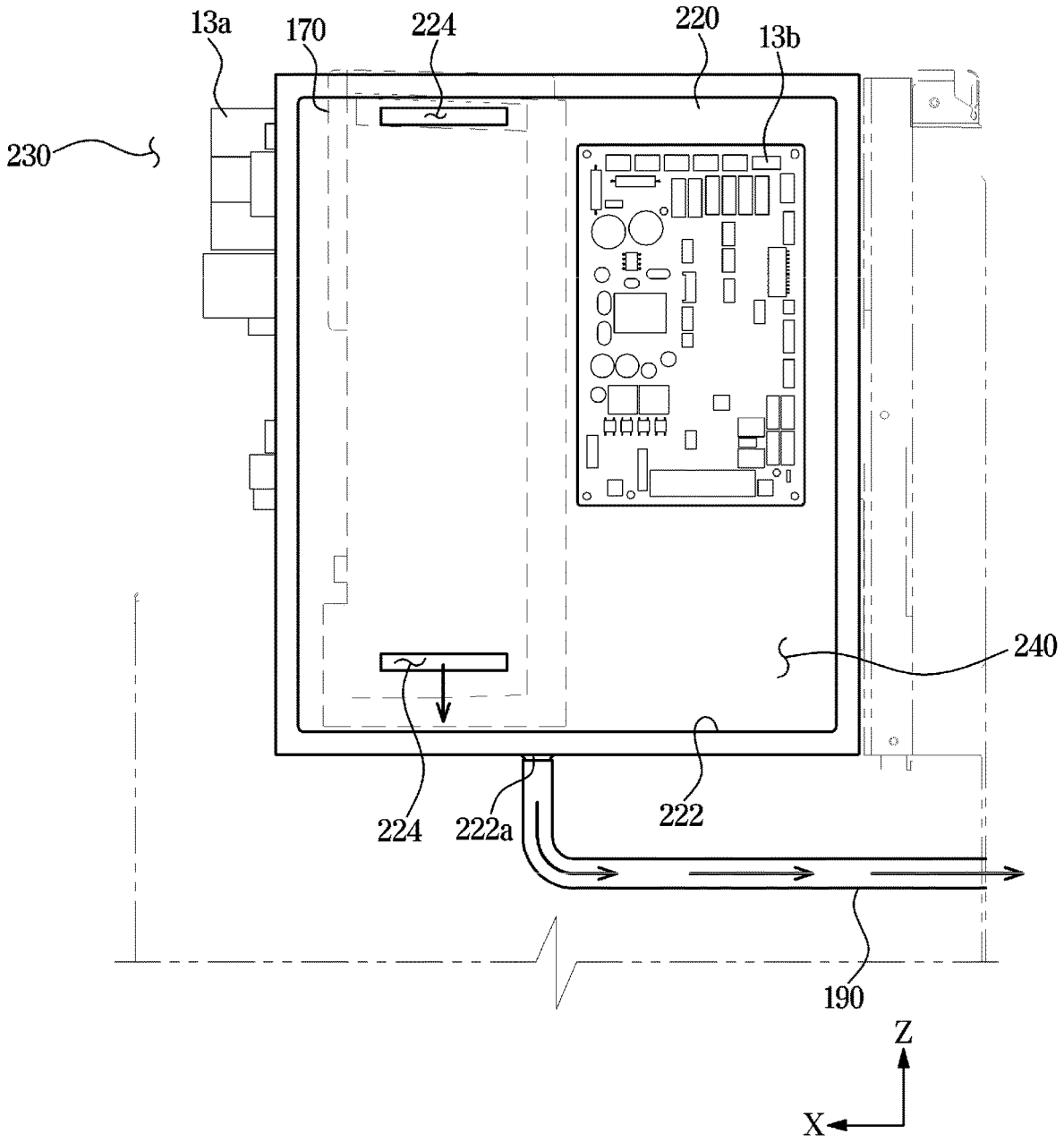
FIG. 19 show flows of air in an outdoor unit of an air conditioner according to an embodiment of the disclosure.

For example, as shown in FIGS. 17 to 19, air and/or a refrigerant existing in the component rooms 230 and 240 may pass through the internal flow path 171 of the guide duct 170 and flow to the outside of the cabinet 100 via the discharge hose 190, in response to a rotation of the blow fan 16 in a first rotation direction.

Figure 20:
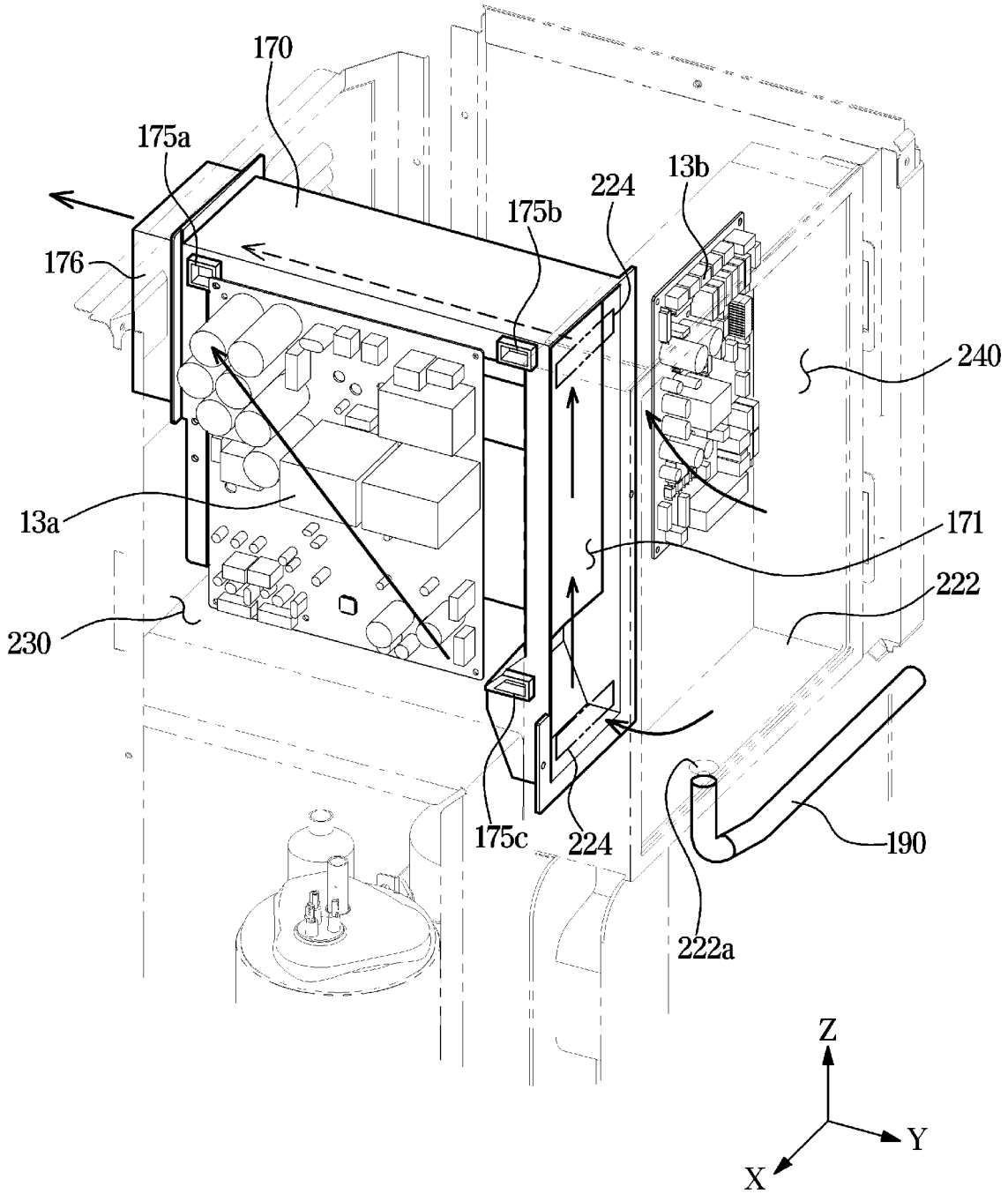
FIG. 20 show flows of air in an outdoor unit of an air conditioner according to an embodiment of the disclosure.
Figure 21:
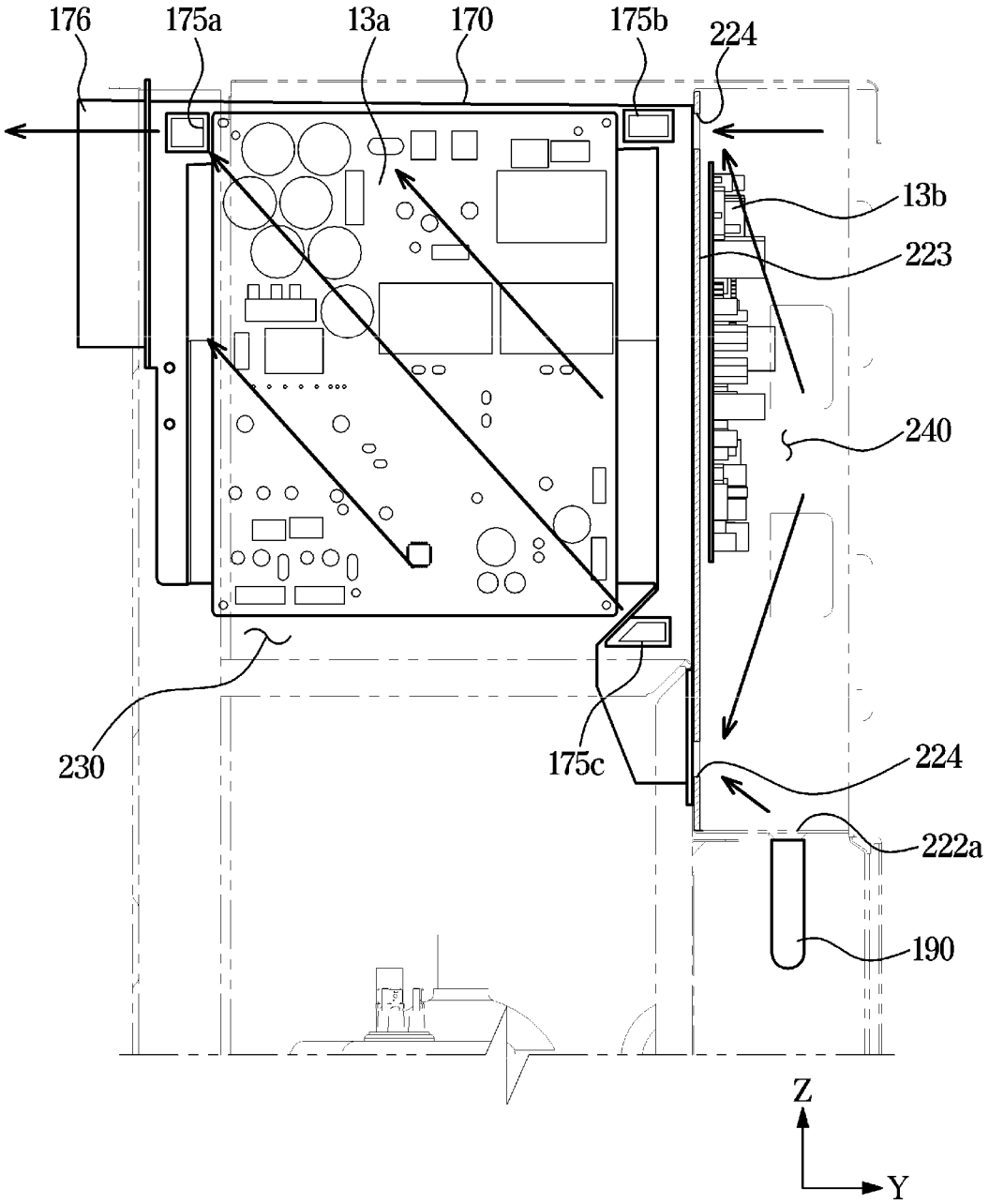
FIG. 21 show flows of air in an outdoor unit of an air conditioner according to an embodiment of the disclosure.
Figure 22:
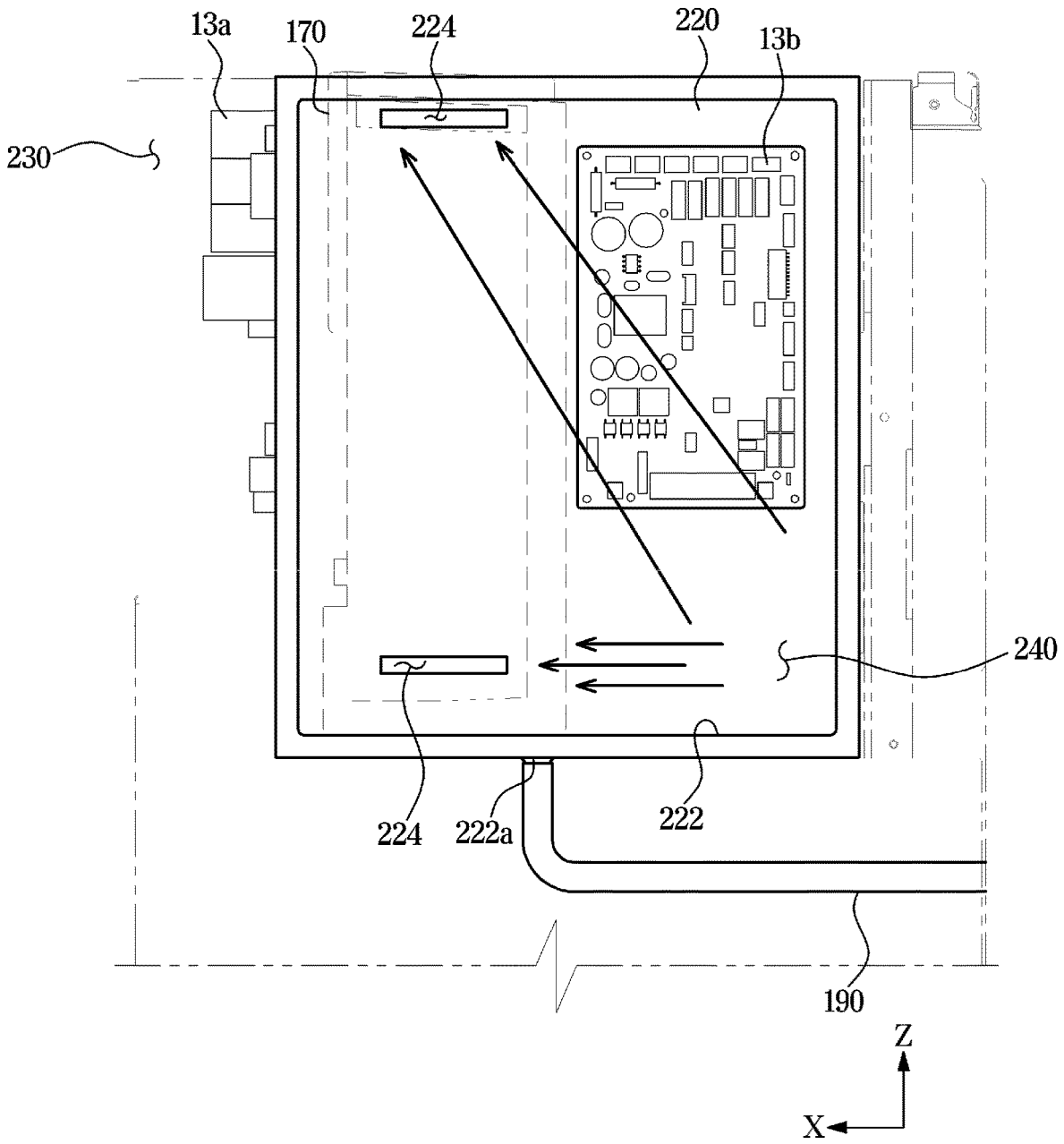
FIG. 22 show flows of air in an outdoor unit of an air conditioner according to an embodiment of the disclosure.

Also, for example, as shown in FIGS. 20 to 22, air and/or a refrigerant existing in the component rooms 230 and 240 may pass through the internal flow path 171 of the guide duct 170 and flow to the heat exchange room R1, in response to a rotation of the blow fan 16 in a second rotation direction.

The refrigerant entered the heat exchange room R1 may flow to the outside of the cabinet 100 through the outlet 120*b*.

A flow path formed by the internal flow path 171, the first duct hole 213, the first component room 230, the second duct hole 224, the second component room 240, and the discharge hose 190 may be referred to as a discharge flow path. The discharge flow path may be referred to as a second discharge flow path.

The cooling flow path 172 may be formed inside the internal flow path 171. The cooling flow path 172 may cool the heat exchange fin 180 and the heat transfer member 181 to which heat from the electric component 13 is transferred. Air flowing from the machine room R2 to the heat exchange room R1 or air flowing from the heat exchange room R1 to the machine room R2 may pass through the cooling flow path 172. For example, the cooling flow path 172 may be provided on a path through which air flows between the machine room R2 and the heat exchange room R1.

The first case 210 may include a front case portion 215. The front case portion 215 may be positioned at the front portion of the first case 210. The front case portion 215 may be in contact with the electric component box 280. The front case portion 215 may include a first part 215*a* extending in the front direction, and a second part 215*b* extending from one end of the first part 215*a* to outside of the first case 210 (see FIG. 14).

The outdoor unit 10 may further include the sealing members 271, 272, and 273. The sealing members 271, 272, and 273 may include the first sealing member 271 for sealing between the first case 210 and the first cover 250, the second sealing member 272 for sealing between the second case 220 and the second cover 260, and the third sealing member 273 for sealing between the electric component box 280 and the heat transfer member 181.

The first sealing member 271 may be positioned between the first case 210 and the first cover 250 in the front-rear direction. For example, the first sealing member 271 may be positioned between the front case portion 215 and the first cover 250. The first sealing member 271 may be positioned at a circumference of the first cover 250.

The second sealing member 272 may be positioned between the second case 220 and the second cover 260 in the front-rear direction. The second sealing member 272 may be positioned at the circumference of the first cover 250.

The third sealing member 273 may be positioned at a circumference of the heat transfer member 181 to seal between the electric component box 280 and the heat exchange member 181. The third sealing member 273 may prevent a refrigerant existing in the component room 230 from leaking toward the heat transfer fin 180. Also, the third sealing member 273 may prevent a refrigerant from flowing from the cooling flow path 172 to the first component room 230.

Figure 14:
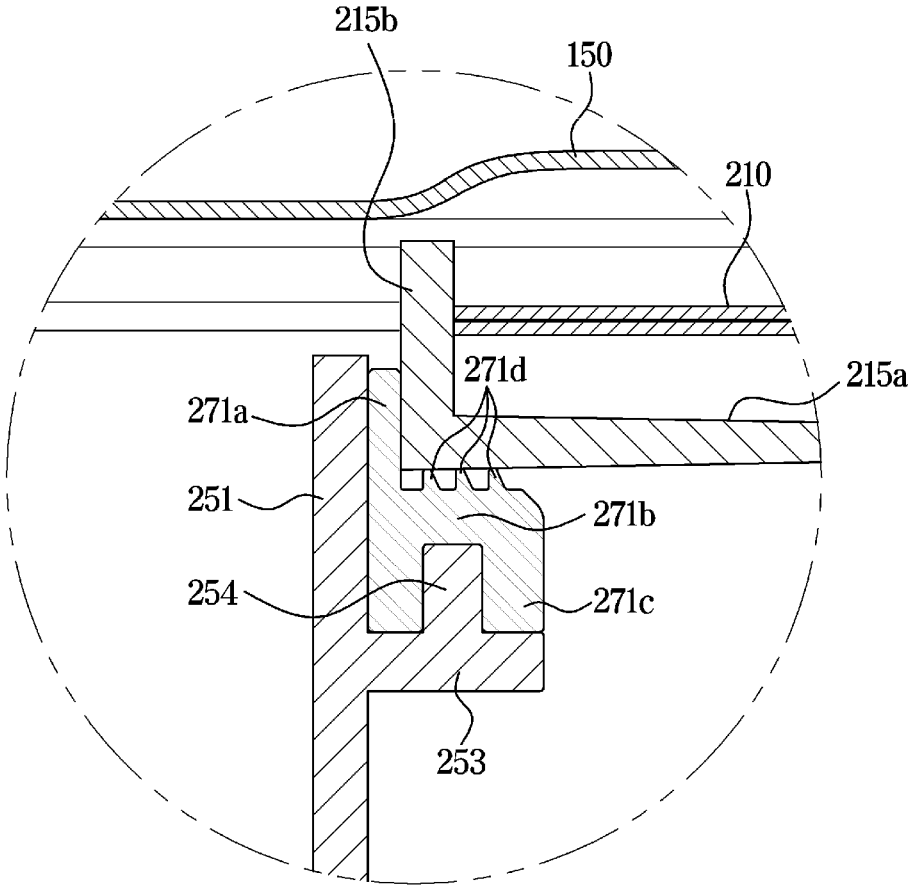
FIG. 14 is an enlarged view of a portion of the outdoor unit shown in FIG. 12.
Figure 15:
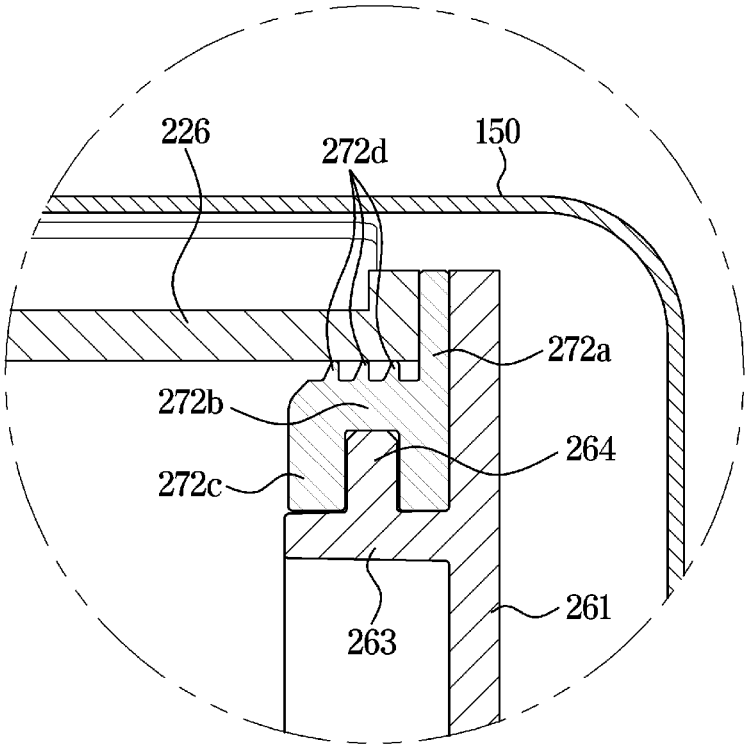
FIG. 15 is an enlarged view of a portion of the outdoor unit shown in FIG. 13.

FIG. 14 is an enlarged view of a portion of an outdoor unit shown in FIG. 12. FIG. 15 is an enlarged view of a portion of the outdoor unit shown in FIG. 13. FIG. 14 is an enlarged view of an 'A' area of FIG. 12. FIG. 15 is an enlarged view of a 'B' area of FIG. 13.

Referring to FIGS. 14 and 15, the sealing members 271 and 272 in the outdoor unit 10 of the air conditioner 1 according to an embodiment of the disclosure may include first sealing portions 271*a* and 272*a*, second sealing portions 271*b* and 272*b*, third sealing portions 271*c* and 272*c*, and fourth sealing portions 271*d* and 272*d*.

The first sealing portions 271*a* and 272*a* may extend in the up-down direction between the component room cases 210 and 220 and the case covers 250 and 260. The first sealing portions 271*a* and 272*a* may be positioned between the first sides of the component room cases 210 and 220 and the case covers 250 and 260. The first sealing portions 271*a* and 272*a* may seal a space between the cases 10 and 220 and the case covers 250 and 260 in the first sides of the component room cases 210 and 220.

According to coupling of the component room cases 210 and 220 with the case covers 250 and 260, portions of the first sealing portions 271*a* and 272*a*, positioned at an area where the component room cases 210 and 220 are coupled to the case covers 250 and 260, may have a thinner thickness that other portions of the first sealing portions 271*a* and 272*a*, not positioned at the area where the component room cases 210 and 220 are coupled to the case covers 250 and 260. For example, the portions of the first sealing portions 271*a* and 272*a*, positioned at the area where the component room cases 210 and 220 are coupled to the case covers 250 and 260, may be compressed.

The second sealing portions 271*b* and 272*b* may be positioned between the component room cases 210 and 220 and the case covers 250 and 260 in the up-down direction. The second sealing portions 271*b* and 272*b* may seal between the component room cases 210 and 220 and the case covers 250 and 260 in the up-down direction. For example, the second sealing portions 271*b* and 272*b* may extend in a direction that is perpendicular to the up-down direction. The second sealing portions 271*b* and 272*b* may extend from the first sealing portions 271*a* and 272*a* toward the component rooms 230 and 240.

The third sealing portions 271*c* and 272*c* may extend between the component room cases 210 and 220 and the case covers 250 and 260 in the up-down direction. The third sealing portions 271*c* and 272*c* may be positioned between the component room cases 210 and 220 and the case covers 250 and 260 in the up-down direction. For example, the third sealing portions 271*c* and 272*c* may seal a space between the component room cases 210 and 220 and the case covers 250 and 260 in the up-down direction. For example, according to coupling of the component room cases 210 and 220 with the case covers 250 and 260, the third sealing portions 271*c* and 272*c* may be positioned between inner walls of the component room cases 210 and 220 and first protrusions of the case covers 250 and 260.

The fourth sealing portions 271*d* and 272*d* may extend from the second sealing portions 271*b* and 272*b* toward the inner walls of the component room cases 210 and 220. The inner walls of the component room cases 210 and 220 may be inner walls forming the component rooms 230 and 240. Each of the fourth sealing portions 271*d* and 272*d* may have a protrusion shape. A plurality of fourth sealing portions 271*d* and 272*d* may be provided. The fourth sealing portions 271*d* and 272*d* may seal a space between the component room cases 210 and 220 and the case covers 250 and 260 in the up-down direction.

In the outdoor unit 10 of the air conditioner 1 according to an embodiment of the disclosure, the case covers 250 and 260 may include first protrusions 253 and 263 and second protrusions 254 and 264.

The first protrusions 253 and 263 may protrude from the cover portions 251 and 261 toward the insides of the component rooms 230 and 240. The first protrusions 253 and 263 may be formed at a circumference of the cover portions 251 and 261. The sealing members 271 and 272 may be positioned between the first protrusions 253 and 263 and the inner walls of the component room cases 210 and 220. The first protrusions 253 and 263 may guide positions of the sealing members 271 and 272 between the component room cases 210 and 220 and the case covers 250 and 260.

The second protrusions 254 and 264 may be inserted between the first sealing portions 271*a* and 272*a* and the third sealing portions 271*c* and 272*c* to fix the sealing members 271 and 272 between the component room cases 210 and 220 and the case covers 250 and 260. The second protrusions 254 and 264 may protrude from the first protrusions 253 and 263 toward the inner walls of the component room cases 210 and 220.

For example, referring to FIG. 14, the first sealing member 271 may be positioned between the first case 210 and the first cover 250. The first sealing member 271 may include the first sealing portion 271*a*, the second sealing portion 271*b*, the third sealing portion 271*c*, and the fourth sealing portion 271*d*.

The first sealing portion 271*a* of the first sealing member 271 may be positioned between the first case 210 and the first cover 250 in the front-rear direction to seal between the first case 210 and the first cover 250 in the front-rear direction.

The second sealing portion 271*b* of the first sealing member 271 may extend from the first sealing portion 271*a* toward the inside of the first case 210. The second sealing portion 271*b* of the first sealing member 271 may extend toward the first component room 230.

The third sealing portion 271*c* of the first sealing member 271 may extend between the first case 210 and the first cover 250 in the up-down direction. The third sealing portion 271*c* of the first sealing member 271 may be positioned between the first case 210 and the first cover 250 in the up-down direction. For example, the third sealing portion 271*c* of the first sealing member 271 may seal a space between the first case 210 and the first cover 250 in the up-down direction. For example, according to coupling of the first case 210 with the first cover 250, the third sealing portion 271*c* of the first sealing member 271 may be positioned between the front case portion 215 of the first case 210 and the first protrusion 253 of the first cover 250.

The fourth sealing portion 271*d* of the first sealing member 271 may extend from the second sealing portion 271*b* toward the inner wall of the first case 210. For example, the fourth sealing portion 271*d* of the first sealing member 271 may protrude toward an inner wall of the first part 215*a* of the front case portion 215. The fourth sealing portion 271*d* may seal a space between the first case 210 and the first cover 250 in the up-down direction.

The first cover 250 may include the first protrusion 253 and the second protrusion 254.

The first protrusion 253 of the first cover 250 may protrude from the cover portion 251 of the first cover 250 toward the inside of the first component room 230. The first protrusion 253 of the first cover 250 may be formed at the circumference of the cover portion 251. The first sealing member 271 may be positioned between the first protrusion 253 of the first cover 250 and the inner wall of the first case 210. The first protrusion 253 of the first cover 250 may guide a position of the first sealing member 271 between the first case 210 and the first cover 250.

The second protrusion 254 of the first cover 250 may be inserted between the first sealing portion 271*a* and the third sealing portion 271*c* of the first sealing member 271 to fix the first sealing member 271 between the first case 210 and the first cover 250. The second protrusion 254 may protrude from the first protrusion 253 toward the inner wall of the first case 210. For example, the second protrusion 254 may protrude from the first protrusion 253 toward the inner wall of the front case portion 215.

Also, for example, referring to FIG. 15, the second sealing member 272 may be positioned between the second case 220 and the second cover 260. The second sealing member 272 may include the first sealing portion 272*a*, the second sealing portion 272*b*, the third sealing portion 272*c*, and the fourth sealing portion 272*d*.

The first sealing portion 272*a* of the second sealing member 272 may be positioned between the second case 220 and the second cover 260 in the left-right direction to seal between the second case 220 and the second cover 260 in the left-right direction.

The second sealing portion 272*b* of the second sealing member 272 may extend from the first sealing portion 272*a* toward an inner side of the second case 220. The second sealing portion 272*b* of the second sealing member 272 may extend toward the second component room 240.

The third sealing portion 272*c* of the second sealing member 272 may extend between the second case 220 and the second cover 260 in the up-down direction. The third sealing portion 272*c* of the second sealing member 272 may be positioned between the second case 220 and the second cover 260 along the up-down direction. For example, the third sealing portion 272*c* of the second sealing member 272 may seal a space between the second case 220 and the second cover 260 in the up-down direction. For example, according to coupling of the second case 220 with the second cover 260, the third sealing portion 272*c* of the second sealing member 272 may be positioned between inner walls 222 and 226 of the second case 220 and the first protrusion 253 of the first cover 250.

The fourth sealing portion 272*d* of the second sealing member 272 may extend and/or protrude from the second sealing portion 272*b* toward the inner walls 222 and 226 of the second case 220. The fourth sealing portion 272*d* may seal the space between the second case 220 and the second cover 260 in the up-down direction.

The second cover 260 may include the first protrusion 263 and the second protrusion 264.

The first protrusion 263 of the second cover 260 may protrude from the cover portion 261 of the second cover 260 toward the inside of the second component room 240. The first protrusion 263 of the second cover 260 may be formed at the circumference of the cover portion 261. The first protrusion 263 of the second cover 260 may enable the second sealing member 272 to be positioned between the first protrusion 263 and the inner walls 222 and 226 of the second case 220. The first protrusion 263 of the second cover 260 may guide a position of the second sealing member 272 between the second case 220 and the second cover 260.

The second protrusion 264 of the second cover 260 may be inserted between the first sealing portion 272*a* and the third sealing portion 272*c* of the second sealing member 272 to fix the second sealing member 272 between the second case 220 and the second cover 260. The second protrusion 264 of the second cover 260 may protrude from the first protrusion 263 of the second cover 260 toward the inner walls 222 and 226 of the second case 220.

Figure 16:
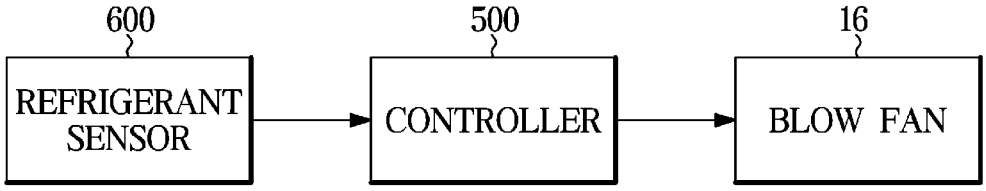
FIG. 16 is a control block diagram of an outdoor unit of an air conditioner according to an embodiment of the disclosure.

FIG. 16 is a control block diagram of an outdoor unit of an air conditioner according to an embodiment of the disclosure.

Referring to FIG. 16, the outdoor unit 10 according to an embodiment of the disclosure may further include a refrigerant sensor 600. For example, the refrigerant sensor 600 may include a gas sensor and a refrigerant pressure sensor for detecting pressure of a refrigerant. However, the refrigerant sensor 600 is not limited to the above example, and may include various kinds of sensors.

The refrigerant sensor 600 may detect a refrigerant entered the machine room R2 or the component rooms 230 and 240 or a refrigerant leaking out of the refrigerant pipe 40. According to identification that a refrigerant has entered the first component room 230 and the second component room 24 or that a refrigerant has leaked out of the refrigerant pipe 40, the refrigerant sensor 600 may send information indicating the entrance of the refrigerant or the leakage of the refrigerant to a controller 500.

The gas sensor of the refrigerant sensor 600 may be positioned at a position being adjacent to the guide 300 or at a position being adjacent to the component rooms 230 and 240. Also, the pressure sensor of the refrigerant sensor 600 may be positioned at the refrigerant pipe 40 connected to the compressor 12. However, a position of the refrigerant sensor 600 is not limited to the above example.

The outdoor unit 10 according to an embodiment of the disclosure may further include the controller 500. The controller 500 may receive information about whether a refrigerant has entered the component rooms 230 and 240 or whether a refrigerant has leaked out of the refrigerant pipe 40, from the refrigerant sensor 600. The controller 500 may operate the blow fan 16 based on the information indicating the entrance of the refrigerant or the leakage of the refrigerant.

According to reception of information indicating that a refrigerant has entered the component rooms 230 and 240 by the controller 500, the controller 500 may rotate the blow fan 16 in the first rotation direction or the second rotation direction to discharge the refrigerant existing inside the component rooms 230 and 240 to the outside of the cabinet 100. A process of discharging a refrigerant according to a rotation of the blow fan 16 will be described with reference to FIGS. 17 to 22.

For example, according to identification by the controller 500 that a refrigerant exists in the component rooms 230 and 240 by receiving information indicating that the refrigerant has entered the component rooms 230 and 240, that is, according to identification that a refrigerant has leaked out and entered the component rooms 230 and 240, the controller 500 may rotate the blow fan 16 in the first rotation direction (for example, a reverse direction) to discharge the refrigerant existing inside the component rooms 230 and 240 to the outside of the cabinet 100 before the outdoor unit 10 operates for heat exchange with outside air, to prevent the refrigerant from reacting with sparks that may be generated in the electric component 13 to cause a fire and/or explosion.

Because eco-friendly refrigerants are combustible and/or explosive, as described above, the outdoor unit 10 according to an embodiment of the disclosure may smoothly discharge a refrigerant leaked out of the refrigerant pipe 40, etc., and entered the component rooms 230 and 240 to thereby prevent a fire and/or explosion of the outdoor unit 10.

FIGS. 17 to 19 show flows of air in an outdoor unit of an air conditioner according to an embodiment of the disclosure.

Referring to FIGS. 17 to 19, in the outdoor unit 10 according to an embodiment of the disclosure, the blow fan 16 may rotate in the first rotation direction. For example, the first rotation direction in which the blow fan 16 rotates may be a reverse direction of a direction in which the blow fan 16 rotates while the heat exchanger 11 operates. The rotation of the blow fan 16 in the reverse direction may be performed for a preset time before the outdoor unit 10 operates and the blow fan 16 rotates in a forward direction. For example, according to identification by the controller 500 that a refrigerant exists in the component rooms 230 and 240 by receiving information indicating that the refrigerant has entered the component rooms 230 and 240, that is, according to identification that a refrigerant has leaked out and entered the component rooms 230 and 240, the controller 500 may rotate the blow fan 16 in the first rotation direction (for example, the reverse direction) to discharge the refrigerant existing inside the component rooms 230 and 240 to the outside of the cabinet 100 before the outdoor unit 10 operates for heat exchange with outside air, to prevent a fire and/or explosion caused by a reaction of the refrigerant with sparks that may be generated in the electric component 13. In this way, by discharging a refrigerant that may remain in the component rooms 230 and 240 to the outside of the cabinet 100 together with air, a fire and explosion of the outdoor unit 10 may be prevented.

According to a rotation of the blow fan 16 in the first rotation direction, a force may be generated in a direction from the heat exchanger 11 toward the second component room 240 and the discharge hose 190. For example, according to a rotation of the blow fan 16 in the first rotation direction, a repulsive force may be generated from the inner flow path 171 toward the second component room 240.

Accordingly, the refrigerant may flow to the outside of the cabinet 100 through the second discharge flow path. Air and/or a refrigerant existing inside the component rooms 230 and 240 may flow toward the discharge hose 190, and the air and refrigerant moved to the discharge hose 190 may flow toward the rear panel 121 through the discharge hose 190 and then be discharged to the outside of the cabinet 100.

For example, a refrigerant existing in the first component room 230 may flow to the internal flow path 171 through the vent 175 formed in the guide duct 170 and the first duct hole 213 formed in the first case 210. Air and a refrigerant existing in an upper and right space of the first component room 230 may flow to the internal flow path 171 through the first vent 175*a*, air and a refrigerant existing in an upper and left space of the first component room 230 may flow to the internal flow path 171 through the second vent 175*b*, and air and a refrigerant existing in a lower and left space of the first component room 230 may flow to the internal flow path 171 through the third vent 175*c*.

The air and refrigerant existing in the first component room 230 may pass through the internal flow path 171 and flow to the second duct hole 224 formed in the second wall 223 of the second case 220. The air and refrigerant passed through the second duct hole 224 may flow to the inside of the second component room 240. Also, the refrigerant may flow downward because the refrigerant is heavier than air. The refrigerant may flow to the discharge hose 190 through the hose hole 222*a* formed in the bottom 222 of the second case 220, and the refrigerant moved to the discharge hose 190 may be discharged to the outside of the cabinet 100 via the second discharge hole 121*a* formed in the rear panel 121 (see FIG. 3).

A refrigerant existing in the second component room 240 may also flow to the discharge hose 190 through the hose hole 222*a* formed in the bottom 222 of the second case 220, and the refrigerant moved to the discharge hose 190 may be discharged to the outside of the cabinet 100 via the second discharge hole 121*a* formed in the rear panel 121.

FIGS. 20 to 22 show flows of air in an outdoor unit of an air conditioner according to an embodiment of the disclosure.

Referring to FIGS. 20 and 22, in the outdoor unit 10 according to an embodiment of the disclosure, the blow fan 16 may rotate in the second rotation direction. The second rotation direction of the blow fan 16 may be a forward direction in which the blow fan 16 rotates while the heat exchanger 11 operates.

According to the rotation of the blow fan 16 in the second rotation direction, an absorptive force may be generated from the component rooms 230 and 240 toward the heat exchange room R1. Accordingly, air and/or a refrigerant existing in the component rooms 230 and 240 may flow toward the heat exchange room R1.

For example, a refrigerant existing in the second component room 240 may flow to the internal flow path 171 through the second duct hole 224 formed in the second wall 223 of the second case 220. The refrigerant existing in the second component room 240 may pass through the internal flow path 171 and the connecting opening 176, flow toward the heat exchange room R1, and arrive at a rear side of the cabinet 100 through the outlet 120*b* (see FIG. 2).

Also, a refrigerant existing in the first component room 230 may also flow to the internal flow path 171 through the vent 175 formed in the guide duct 170 and the first duct hole 213 formed in the first case 210. Any refrigerant collected in a lower space of the first component room 230 may flow toward the first connecting opening 176 and flow to the internal flow path 171. The refrigerant existing in the first component room 230 may pass through the internal flow path 171 and the connecting opening 176, flow toward the heat exchange room R1, and flow to the rear side of the cabinet 100 through the outlet 120*b*.

For example, according to identification by the controller 500 that a refrigerant exists in the component rooms 230 and 240 by receiving information indicating that the refrigerant has entered the component rooms 230 and 240, that is, according to identification that a refrigerant has leaked out and entered the component rooms 230 and 240, the controller 500 may rotate the blow fan 16 in the second rotation direction (for example, the forward direction) to discharge the refrigerant existing inside the component rooms 230 and 240 to the outside of the cabinet 100, to prevent a fire and/or explosion caused by a reaction of the refrigerant with sparks that may be generated in the electric component 13.

Figure 23:
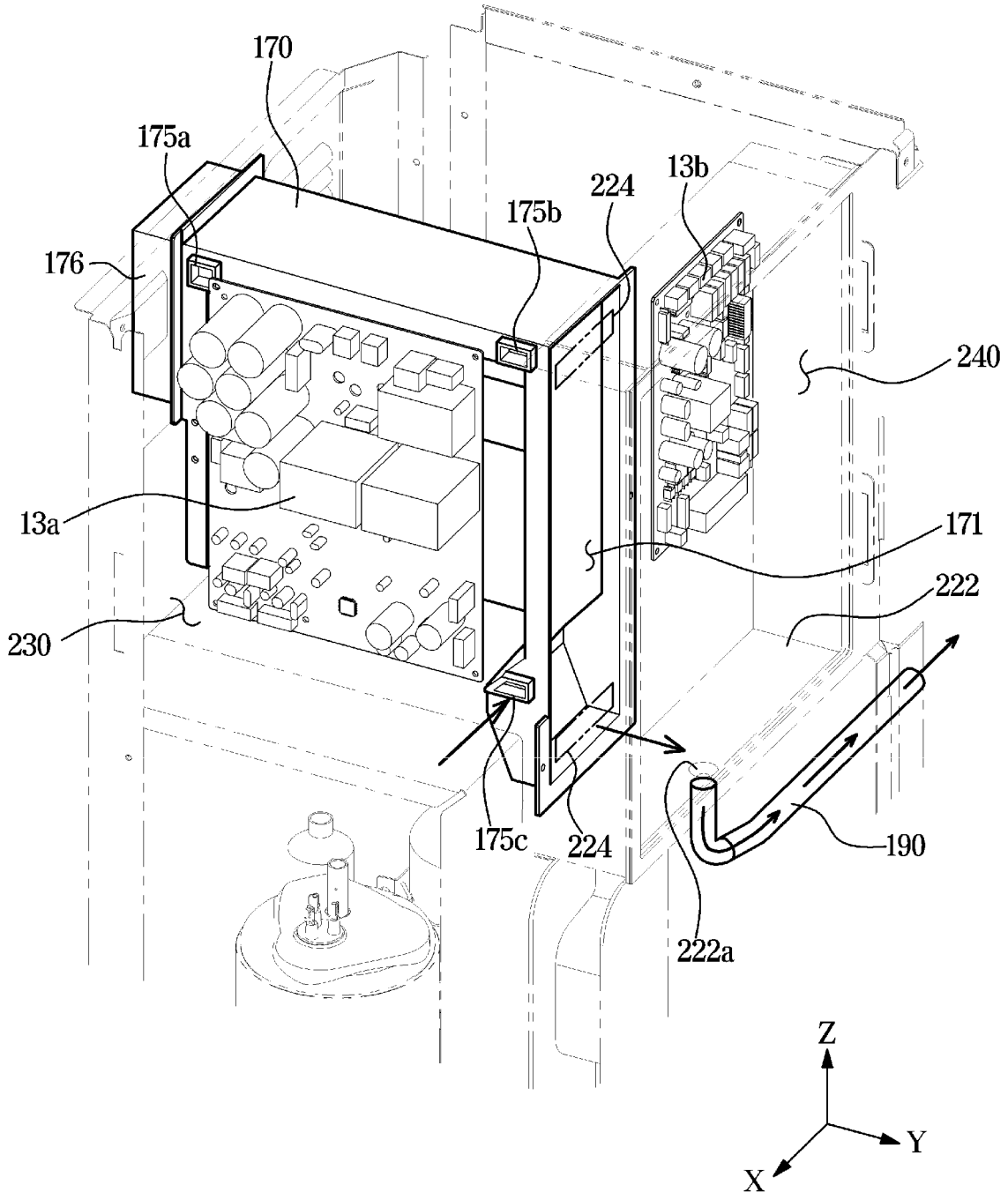
FIG. 23 show flows of air in an outdoor unit of an air conditioner according to an embodiment of the disclosure.
Figure 24:
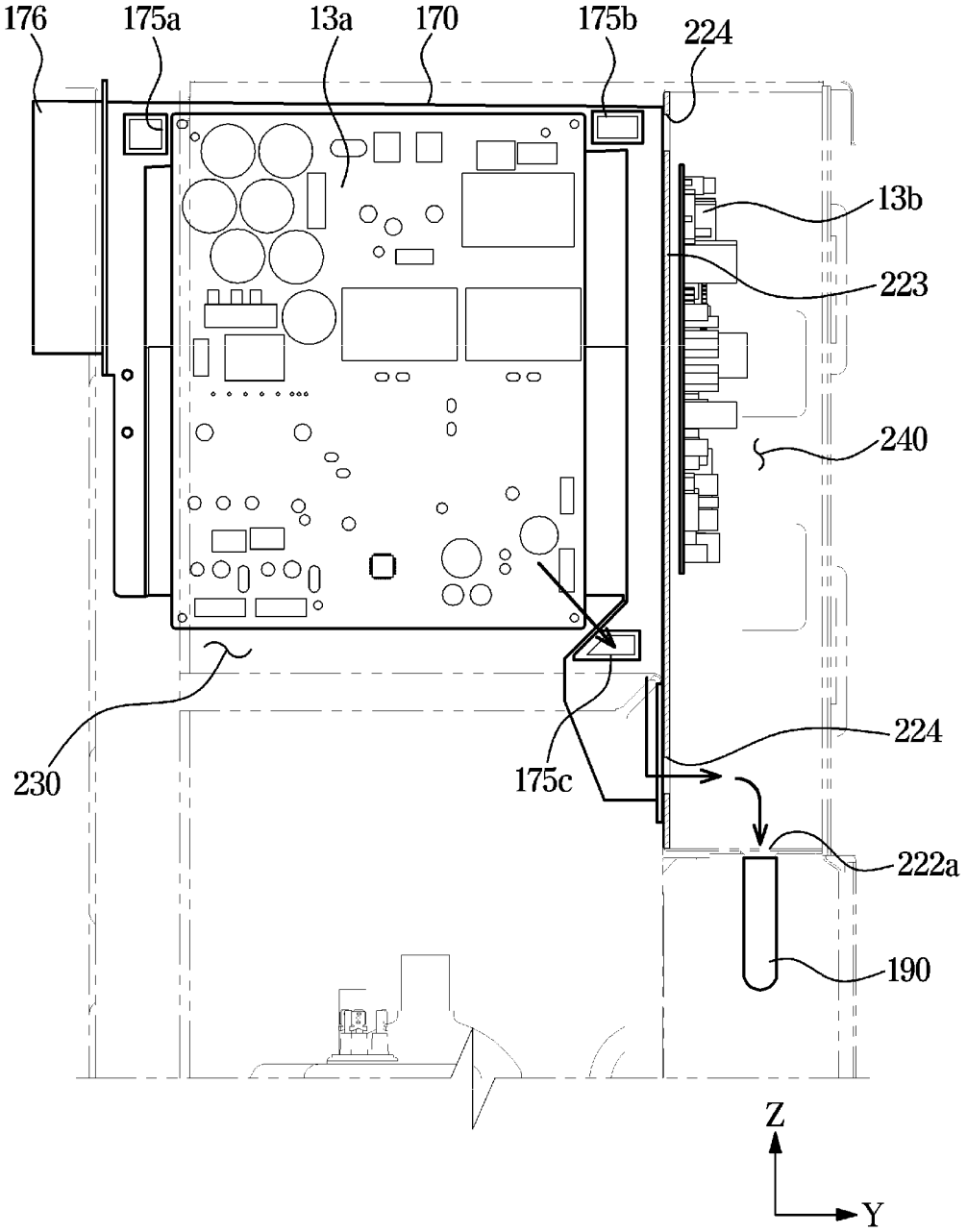
FIG. 24 show flows of air in an outdoor unit of an air conditioner according to an embodiment of the disclosure.
Figure 25:
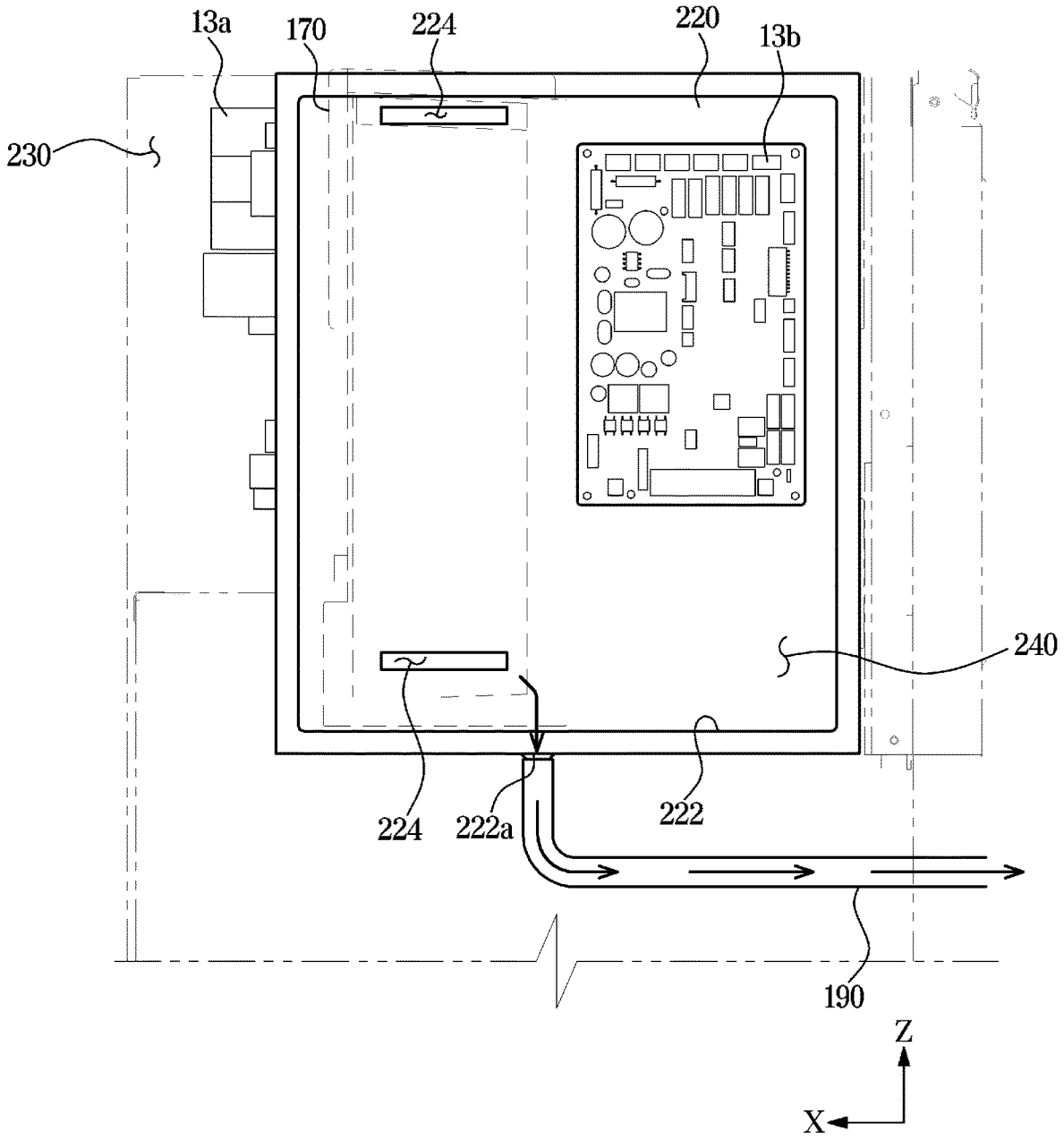
FIG. 25 show flows of air in an outdoor unit of an air conditioner according to an embodiment of the disclosure.

FIGS. 23 to 25 show flows of air in an outdoor unit of an air conditioner according to an embodiment of the disclosure.

Referring to FIGS. 23 to 25, in the outdoor unit 10 according to an embodiment of the disclosure, the blow fan 16 may not rotate.

Upon use of a refrigerant that is heavier than air, the refrigerant existing in the component rooms 230 and 240 may flow toward the discharge hose 190 although the blow fan 16 does not rotate. Upon use of a refrigerant such as R290, the refrigerant may flow toward the discharge hose 190 because the refrigerant is heavier than air.

For example, the refrigerant existing in the first component room 230 may flow to the internal flow path 171 through the first duct hole 213 formed in a lower portion of the first case 210 and the third vent 175*c* formed in a lower portion of the guide duct 170.

The air and refrigerant existing in the first component room 230 may pass through the internal flow path 171 and flow to the second duct hole 224. For example, the refrigerant may pass through the second duct hole 224 formed in the lower portion of the side wall 223 of the second case 220 among the second duct holes 224, and flow to the second component room 240. Thereafter, the refrigerant may flow to the discharge hose 190 through the hose hole 222*a* formed in the bottom 222 of the second case 220, and the refrigerant moved to the discharge hose 190 may pass through the second discharge hole 121*a* formed in the rear panel 121 and be discharged to the outside of the cabinet 100 (see FIG. 3).

The refrigerant existing in the second component room 240 may flow to the discharge hose 190 through the hose hole 222*a* formed in the bottom 222 of the second case 220, and the refrigerant moved to the discharge hose 190 may pass through the second discharge hole 121*a* formed in the rear panel 121 and be discharged to the outside of the cabinet 100.

Embodiments of the disclosure may provide an air conditioner including a cabinet; a heat exchange room formed in the cabinet; a blow fan positioned inside the heat exchange room and configured to form air current; a heat exchanger positioned inside the heat exchange room and configured to perform heat exchange with air moved by the blow fan; a guide duct connected to the heat exchange room and configured to guide air moved by the blow fan; a component room accommodating an electric component to control the heat exchanger, positioned to one side of the guide duct, and connected to the guide duct; a duct hole provided in one wall forming the electric component room to communicate the component room with the inside of the guide duct; and a discharge hole formed in one wall of the cabinet and configured to discharge a refrigerant existing in the component room to outside of the cabinet through the guide duct, the discharge hole communicating the component room with the outside of the cabinet, wherein air moved by the blow fan flows to the outside of the cabinet through the discharge hole.

The outdoor unit may further include a discharge hose connecting the component room and the discharge hole so that the refrigerant flows from the component room to the discharge hole.

The refrigerant existing in the guide duct and the component room may move to the heat exchange room, in response to a rotation of the blow fan in one direction, and the refrigerant existing in the guide duct and the component room may flow to the outside of the cabinet through the discharge hose, in response to a rotation of the blow fan in an opposite direction of the one direction.

The outdoor unit may further include a component room case forming the component room; and a hose hole configured to connect to the discharge hose and formed in a bottom of the component room case.

Embodiments of the disclosure may provide an air conditioner including a cabinet including a front panel and a rear panel; a heat exchanger positioned inside the cabinet; a compressor positioned inside the cabinet and connected to the heat exchanger; a refrigerant pipe positioned inside the cabinet and connecting the heat exchanger to the compressor; a component room provided inside the cabinet and accommodating an electric component to control the compressor; a first discharge hole formed in the front panel below the component room, communicating inside of the cabinet with outside of the cabinet, and configured to discharge a refrigerant leaking out of the refrigerant pipe to the outside of the cabinet; and a guide positioned below the component room, and including a protrusion portion protruding toward the front panel and guiding the refrigerant to the first discharge hole; and a second discharge hole formed in the rear panel, communicating the component room with the outside of the cabinet, and configured to discharge a refrigerant entered the component room to the outside of the cabinet.

According to an aspect of the disclosure, there is provided an outdoor unit of an air conditioner that is capable of preventing a refrigerant from reacting with sparks that may be generated in an electric component because the refrigerant is discharged to the outside of a cabinet through a discharge hole formed in the cabinet.

According to an aspect of the disclosure, there is provided an outdoor unit of an air conditioner that is capable of preventing a fire and explosion of the outdoor unit because any leaking refrigerant is discharged to the outside of a cabinet through a guide duct and a discharge hose without being collected inside component rooms.

Effects according to an aspect of the disclosure are not limited to the above-mentioned those, and other effects not mentioned may be clearly understood by one of ordinary skill in the technical art to which the disclosure belongs from the following descriptions.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. An outdoor unit of an air conditioner, comprising:

a cabinet;

a heat exchange room inside the cabinet and accommodating a heat exchanger;

a first component room case at one side of the heat exchange room, and including an opening in a first side of the first component room case;

a first component room inside the first component room case;

a first electric component in the first component room;

a first case cover configured to cover the opening of the first component room case;

a sealing member between the first component room case and the first case cover;

a duct at a second side of the first component room case, and connected to the heat exchange room; and a first duct hole in the second side of the first component room case and connecting the first component room case and the duct, wherein the first component room case and the duct are configured so that:

a refrigerant in the first component room flows through the first duct hole, and then through the duct, to outside of the cabinet; and a discharge hose connecting the first component room case and the cabinet so that the refrigerant in the first component room flows from the first component room through the discharge hose to outside of the cabinet.

2. The outdoor unit of the air conditioner of claim 1, further comprising:

a blow fan inside the heat exchange room and configured to move air, wherein the refrigerant in the first component room flows through the discharge hose to outside of the cabinet in response to a rotation of the blow fan in a first rotation direction.

3. The outdoor unit of the air conditioner of claim 2, wherein the refrigerant in the first component room flows from the first component room through the first duct hole, then through the duct to the heat exchange room in response to a rotation of the blow fan in a second rotation direction.

4. The outdoor unit of the air conditioner of claim 3, further comprising:

a second component room beside the first component room, wherein the second component room is in a front area of the cabinet, and the duct communicates with the heat exchange room, the first component room, and the second component room.

5. The outdoor unit of the air conditioner of claim 4, further comprising:

a second component room case beside the first component room case, and including an opening in a first side of the second component room case, the second component room inside the second component room case; and a second duct hole formed in a second side of the second component room case and connecting the second component room case and the duct, wherein the first component room case includes a hose hole in a bottom of the first component room case connecting the discharge hose to the first component room case.

6. The outdoor unit of the air conditioner of claim 5, wherein the first duct hole includes a plurality of first duct holes, the second duct hole includes a plurality of second duct holes, the plurality of first duct holes are formed at upper and lower portions of the second side of the first component room case, the plurality of second duct holes are formed at upper and lower portions of the second side of the second component room case, and refrigerant in the second component room flows through second duct holes of the plurality of second duct holes formed at the lower portion of the second side of the second component room case, then through the duct, then through first duct holes of the plurality of first duct holes formed at the lower portion of the second side of the first component room case, and then through the hose hole to the discharge hose while the blow fan does not rotate.

7. The outdoor unit of the air conditioner of claim 1, wherein the sealing member includes:

a first sealing portion extending from between the first component room case and the first case cover to between the first case cover and the opening of the first component room case, a second sealing portion extending from the first sealing portion toward inside of the first component room case, a third sealing portion extending from the second sealing portion toward a center of the opening of the first component room case, and a fourth sealing portion extending from the second sealing portion to contact an inner portion of the first component room case.

8. The outdoor unit of the air conditioner of claim 7, wherein the first case cover includes:

a cover portion configured to cover the first side of the first component room case, a first protrusion protruding from the cover portion toward the inside of the first component room and configured to guide the sealing member between the first component room case and the first case cover, and a second protrusion protruding from the first protrusion toward the inner portion of the first component room case and inserted between the first sealing portion and the third sealing portion.

9. The outdoor unit of the air conditioner of claim 8, further comprising:

a second component room case beside the first component room case in a front area of the cabinet, and including an opening in a first side of the second component room case;

a second component room inside the second component room case;

a second electric component in the second component room; and a second case cover configured to cover the opening of the second component room case, wherein the sealing member includes:

a first sealing member between the first component room case and the first case cover, and a second sealing member between the second component room case and the second case cover.

10. The outdoor unit of the air conditioner of claim 9, further comprising:

an electric component box positioned inside the second component room case and accommodating the second electric component;

a heat transfer member positioned behind the electric component box and configured to receive heat generated in the second electric component;

a heat exchange fin positioned inside the duct and coupled to the heat transfer member to cool the second electric component; and a third sealing member at a circumference of the heat transfer member.

11. The outdoor unit of the air conditioner of claim 1, wherein the cabinet includes a front panel, the outdoor unit of the air conditioner further including:

a discharge hole in the front panel below the first component room, and configured to communicate inside of the cabinet with outside of the cabinet to prevent refrigerant inside the cabinet from flowing into the first component room, and a guide inside the cabinet and adjacent to the front panel below the first component room, and configured to guide the refrigerant inside the cabinet to the discharge hole.

12. The outdoor unit of the air conditioner of claim 11, wherein the guide includes:

a base extending in an up-down direction, a pair of panel portions at both respective sides of the base to accommodate a wire connected to the first electric component, and a protrusion portion protruding in a front direction from the base and configured to guide the refrigerant to the discharge hole.

13. The outdoor unit of the air conditioner of claim 12, further comprising:

a blocking member between the front panel and the protrusion portion, and configured to block the refrigerant inside the cabinet from flowing from a lower portion of the cabinet to the first component room.

14. The outdoor unit of the air conditioner of claim 13, wherein a portion of the front panel corresponding to the protrusion portion protrudes in the front direction, and the discharge hole extends from a same position as the guide to a base of the cabinet.

* * * * *